US009903064B2

(12) United States Patent
Del Pos et al.

(10) Patent No.: US 9,903,064 B2
(45) Date of Patent: Feb. 27, 2018

(54) LAUNDRY WASHING MACHINE

(71) Applicant: Electrolux Appliances Aktiebolag, Stockholm (SE)

(72) Inventors: Maurizio Del Pos, Pordenone (IT); Daniele Favaro, Venice (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/765,984

(22) PCT Filed: Feb. 6, 2013

(86) PCT No.: PCT/EP2013/052275
§ 371 (c)(1),
(2) Date: Aug. 5, 2015

(87) PCT Pub. No.: WO2014/121821
PCT Pub. Date: Aug. 14, 2014

(65) Prior Publication Data
US 2015/0368847 A1 Dec. 24, 2015

(51) Int. Cl.
*D06F 39/02* (2006.01)
*D06F 39/00* (2006.01)
(Continued)

(52) U.S. Cl.
CPC ..... *D06F 39/028* (2013.01); *D06F 39/005* (2013.01); *D06F 39/007* (2013.01);
(Continued)

(58) Field of Classification Search
CPC ..... D06F 39/007; D06F 39/02; D06F 39/022; D06F 39/028; A47L 15/4229
(Continued)

(56) References Cited

U.S. PATENT DOCUMENTS 3,148,687 A 9/1964 Dosch
3,386,582 A * 6/1968 Brezosky ..... A47L 15/4229 210/136
(Continued)

FOREIGN PATENT DOCUMENTS

DE 3520202 A1 12/1986
DE 3521598 A1 12/1986
(Continued)

OTHER PUBLICATIONS

Stamminger, "Domestic washing machine for domestic laundry" Apr. 2004, DE 10245281—Machine Translation.*
(Continued)

*Primary Examiner* — David G Cormier
*Assistant Examiner* — Thomas Bucci
(74) *Attorney, Agent, or Firm* — Banner & Witcoff, Ltd.

(57) ABSTRACT

A laundry washing machine (1) has an outer casing (2) and, inside the outer casing (2), a washing tub (3), a detergent dispensing assembly (9) structured for supplying detergent into the washing tub (3), and a fresh-water supply circuit (10) structured for selectively channeling a flow of fresh water from the water mains towards the detergent dispensing assembly (9) and/or the washing tub (3). A water softening device (12) is arranged/located along the fresh-water supply circuit (10) and is structured for reducing the hardness degree of the fresh water channeled to the detergent dispensing assembly (9) and/or the washing tub (3). The water softening device (12) being internally provided with a given amount of water softening agent able to reduce the hardens degree of the fresh water flowing through the same water softening device (12), and with a given amount of consumable regeneration agent, able to regenerate the water softening function of the water softening agent. The laundry washing machine (1) further has an appliance control panel
(Continued)

(11) located on a front wall (2*a*) of the casing (2), close to a worktop (2*b*) of the casing (2), and structured for allowing the user to manually select the desired washing-cycle. The water softening device (12) being provided with a loading inlet or mouth (33*a*, 52) structured for allowing the user to load a regeneration agent inside the same internal water softening device (12) and arranged/located inside the casing (2) so that its loading inlet or mouth (33*a*, 52) is exposed or exposable to the outside on said worktop (2*b*) of the casing (2), substantially behind the appliance control panel (11).

18 Claims, 8 Drawing Sheets

(51) Int. Cl.
*D06F 39/08* (2006.01)
*D06F 39/12* (2006.01)

(52) U.S. Cl.
CPC ..... *D06F 39/02* (2013.01); *D06F 39/022* (2013.01); *D06F 39/088* (2013.01); *D06F 39/12* (2013.01)

(58) Field of Classification Search
USPC ..... 68/13 A, 17 A, 12.18, 207, 13 R, 200, 68/23.5, 12.13; 134/57 D, 58 D, 93, 109, 134/56 D, 100.1, 26, 94.1, 95.1, 98.1, 29; 210/190, 191, 136, 140, 687; 222/651, 222/129, 325, 132, 145.5, 318
See application file for complete search history.

(56) References Cited

U.S. PATENT DOCUMENTS

| | | | | |
|---|---|---|---|---|
| 6,557,382 | B1 * | 5/2003 | Koike | D06F 39/007 68/13 A |
| 6,766,812 | B1 | 7/2004 | Gadini | |
| 2006/0117811 | A1 | 6/2006 | Kinnetz | |
| 2006/0191299 | A1 | 8/2006 | Tobias et al. | |
| 2009/0266115 | A1 * | 10/2009 | Cao | D06F 39/007 68/13 A |
| 2010/0000027 | A1 | 1/2010 | Bae et al. | |
| 2010/0139328 | A1 | 6/2010 | Favaro | |

FOREIGN PATENT DOCUMENTS

| | | | | |
|---|---|---|---|---|
| DE | 3527047 | A1 | 2/1987 | |
| DE | 10245281 | A1 * | 4/2004 | D06F 39/02 |
| DE | 102008027726 | B3 | 10/2009 | |
| EP | 0496957 | A1 | 8/1992 | |
| EP | 1085118 | A2 | 3/2001 | |
| EP | 2113602 | A1 | 11/2009 | |
| EP | 2554739 | A1 | 2/2013 | |
| WO | 2011128745 | A2 | 10/2011 | |
| WO | 2011154426 | A1 | 12/2011 | |

OTHER PUBLICATIONS

International Search Report dated May 29, 2013 in related International Application No. PCT/EP2013/052275.
International Search Report dated May 29, 2013 in related International Application No. PCT/EP2013/052272.
International Search Report dated Jun. 4, 2013 in related International Application No. PCT/EP2013/052299.
International Search Report dated Jun. 4, 2013 in related International Application No. PCT/EP2013/052303.
Mar. 20, 2017—U.S. Final Office Action—U.S. Appl. No. 14/765,977.
Aug. 11, 2016—U.S.Non-Final Office Action—U.S. Appl. No. 14/765,977.
Aug. 12, 2016—U.S. Non-Final Office Action—U.S. Appl. No. 14/765,997.
May 19, 2017—U.S. Non-Final Office Action—U.S. Appl. No. 14/766,005.

* cited by examiner

LAUNDRY WASHING MACHINE

BACKGROUND

The present invention relates to a laundry washing machine.

In particular, the present invention relates to a front-loading home laundry washing machine, to which the following description refers purely by way of example without this implying any loss of generality.

As is known, currently marketed front-loading home laundry washing machines generally comprise: a substantially parallelepiped-shaped outer boxlike casing structured for resting on the floor; a substantially bell-shaped washing tub which is suspended in floating manner inside the casing, directly facing a laundry loading/unloading through opening realized in the front wall of the casing; a substantially cylindrical elastically-deformable bellows, which connects the front opening of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; a substantially cylindrical, bell-shaped rotatable drum structured for housing the laundry to be washed, and which is arranged inside the washing tub with its concavity facing the laundry loading/unloading opening and is supported in axially rotating manner so as to be able to freely rotate about its substantially horizontally-oriented longitudinal axis; and finally an electrically-powered motor assembly which is structured for driving into rotation the rotatable drum about its longitudinal axis inside the washing tub.

Alike any other home laundry washing machine, this type of laundry washing machine is furthermore provided with a detergent dispensing assembly which is generally located inside the boxlike casing, immediately above the washing tub, and is structured for selectively feeding into the washing tub, according to the washing cycle manually-selected by the user via a control panel generally located on the front wall of the boxlike casing, a given amount of detergent, softener and/or other washing agent suitably mixed with fresh water arriving from the water mains; and with a fresh-water supply circuit which is structured for selectively drawing fresh water from the water mains according to the washing cycle manually-selected by the user, and channelling said water into the detergent dispensing assembly or directly into the washing tub.

The detergent dispensing assembly, in turn, generally comprises: a detergent drawer which is usually divided into a number of detergent compartments each structured for being manually fillable with a corresponding detergent product, and which is fitted/inserted in manually extractable manner into a completely recessed drawer housing whose entrance is usually located on front wall of the boxlike casing, above the porthole door, and whose bottom directly communicates with the inside of the washing tub via a connecting duct; and a drawer flush circuit which receives the fresh water from the fresh-water supply circuit, and is structured to selectively and alternatively channel said fresh water into any one of the detergent compartments of the detergent drawer, so as to selectively flush the detergent, softener or other washing agent out of the corresponding detergent compartment and down on the bottom of the drawer housing which, in turn, communicates with the inside of the washing tub.

As is known the hardness of the fresh water channelled into the washing tub deeply negatively influences the cleaning efficiency of the detergents and softeners used in the washing cycle, thus the user is usually requested to considerably increase, when the hardness degree of the fresh water is too high, the amount of detergent and softener used in the washing cycle and/or to mix the detergent with a given amount of very expensive, generally polycarboxylates-based, water-softening chemical product.

The European patent application No. 1085118 discloses a front-loading home laundry washing machine provided with an internal water softening device capable of reducing, during each washing cycle, the hardness degree of the fresh water used in the washing cycle. This internal water softening device uses ion-exchange resins to restrain calcium and magnesium ions (Ca++ an Mg++) dissolved in the fresh water channelled to the washing tub, and uses brine (i.e. salt water) to periodically regenerate these ion-exchange resins. Salt water, in fact, is able to remove from the ion-exchange resins the calcium and magnesium ions previously combined/fixed to said resins.

Unluckily integration of the salt reservoir on the back of the detergent drawer has brought to a very complicated detergent drawer structure with a consequent significant increase in the detergent dispensing assembly overall production costs.

Moreover the brine accidentally coming out of the salt reservoir during the drawer movement accumulates on the bottom of the drawer housing which is in direct communication with the upper portion of the washing tub, thus the brine can reach quite easily the outer surface of the rotatable drum with all problems concerned. The rotatable drum, in fact, is generally made of metal material and gets rusty very quickly in presence of brine.

Last but not less important, the capacity of the salt reservoir on the back of the detergent drawer is too limited for the everyday-use typical of a traditional home laundry washing machine. It is unacceptable for a normal user to refill the salt reservoir every 3-4 washing cycles.

SUMMARY OF SELECTED INVENTIVE ASPECTS

An aim of the present invention is therefore to realize an internal water softening device designed to eliminate the drawbacks referred above.

In compliance with the above aims, according to an aspect of the present invention there is provided a laundry washing machine comprising an outer casing and, inside said outer casing, a washing tub, a rotatable drum housed in axially rotatable manner inside the washing tub and structured for housing the laundry to be washed, a detergent dispensing assembly which is structured for supplying detergent into the washing tub, a fresh-water supply circuit which is structured for selectively channeling a flow of fresh water from the water mains towards the detergent dispensing assembly and/or the washing tub, and a water softening device which is arranged/located along the fresh-water supply circuit and is structured for reducing the hardness degree of the fresh water channelled to the detergent dispensing assembly and/or the washing tub; the water softening device in turn comprising a water-softening agent container which is arranged/located along the fresh-water supply circuit and is filled with a water softening agent able to reduce the hardness degree of the fresh water flowing through the same water-softening agent container, and a regeneration-agent reservoir which is fluidically connected to the water-softening agent container and is structured to receive a consumable regeneration agent for performing a regeneration of the water softening function of the water softening agent stored into the water-softening agent container; the laundry washing machine furthermore comprising an appliance control panel which is located on a front wall of the casing, close to a worktop of the casing, and is structured for allowing the user to manually select the desired washing-cycle, and being characterized in that the regeneration-agent reservoir is provided with a loading inlet or mouth structured for allowing the user to load a regeneration agent inside the same regeneration-agent reservoir, and is arranged/located inside the casing so that said loading inlet or mouth is exposed or exposable to the outside of the casing and is moreover located/arranged on a portion of said worktop located behind the appliance control panel.

Preferably, though not necessarily, the laundry washing machine is furthermore characterized in that the exposed or exposable loading inlet or mouth of the regeneration-agent reservoir is arranged/located on a portion of the worktop extending between the appliance control panel and the back wall of the casing.

Preferably, though not necessarily, the laundry washing machine is furthermore characterized in that the loading inlet or mouth of the regeneration-agent reservoir is freely accessible by the user through a manually-operated closure assembly provided on the worktop of the casing.

Preferably, though not necessarily, the laundry washing machine is furthermore characterized in that said manually-operated closure assembly comprises a door provided on the worktop of the casing; said door being movable to and from a closing position wherein the door hides the loading inlet or mouth of the regeneration-agent reservoir.

Preferably, though not necessarily, the laundry washing machine is furthermore characterized in that said door forms a portion of the worktop of the casing.

Preferably, though not necessarily, the laundry washing machine is furthermore characterized in that the worktop of the casing is provided with a inner shelf which is arranged beneath the door, and the loading inlet or mouth of the water softening device is located/incorporated into said inner shelf.

Preferably, though not necessarily, the laundry washing machine is furthermore characterized in that the appliance control panel is located substantially beneath the worktop of the casing, substantially on the upper left corner of the front wall of said casing.

Preferably, though not necessarily, the laundry washing machine is furthermore characterized in that the detergent dispensing assembly is provided with a corresponding loading inlet or mouth which is structured for allowing the user to load the washing agent inside the same detergent dispensing assembly, and it is moreover arranged/located inside the casing so that its loading inlet or mouth is exposed or exposable to the outside on the front wall of the casing.

Preferably, though not necessarily, the laundry washing machine is furthermore characterized in that the detergent dispensing assembly is arranged/located inside the casing so that its loading inlet or mouth is exposed or exposable to the outside on the front wall of the casing substantially beside the appliance control panel.

Preferably, though not necessarily, the laundry washing machine is furthermore characterized in that the detergent dispensing assembly comprises a detergent container which is fillable with a given quantity of detergent, softener and/or other washing agent, and which is housed inside the casing into a corresponding container housing; the front wall of the casing being provided with a corresponding pass-through opening through which the detergent container is accessible by the user.

Preferably, though not necessarily, the laundry washing machine is furthermore characterized in that the detergent dispensing assembly comprises a detergent drawer which is manually fillable with a given quantity of detergent, softener and/or other washing agent, and is fitted/inserted in manually extractable manner into a recessed drawer housing which extends inside the casing while remaining above the washing tub, and communicates with the outside of the casing via a front entrance or opening realized on the front wall of the casing beside the appliance control panel.

Preferably, though not necessarily, the laundry washing machine is furthermore characterized in that the water softening device furthermore comprises a water supply circuit which is structured for channelling a given amount of fresh water into the regeneration-agent reservoir so to at least partly dissolve the regeneration agents stored therein to form some brine.

Preferably, though not necessarily, the laundry washing machine is furthermore characterized in that the water softening device furthermore comprises a pump assembly or valve assembly which is interposed between the water-softening agent container and the regeneration-agent reservoir, and which is structured for regulating/controlling the outflow of the brine from the regeneration-agent reservoir to the water-softening agent container.

Preferably, though not necessarily, the laundry washing machine is furthermore characterized in that the regeneration-agent reservoir comprises a substantially basin-shaped, regeneration-agent container which is manually fillable with a given quantity of consumable regeneration agent, and is recessed/incorporated into the worktop of the casing on a portion of the worktop located behind the appliance control panel, so that its mouth is freely accessible by the user.

Preferably, though not necessarily, the laundry washing machine is furthermore characterized in that the regeneration-agent container is recessed/incorporated into the inner shelf of the worktop behind the appliance control panel, so that the mouth of the regeneration-agent container is freely accessible by the user through the manually-operated closure assembly.

Preferably, though not necessarily, the laundry washing machine is furthermore characterized in that the water supply circuit of the water softening device is structured for spilling/pouring a shower of the water droplets by gravity into the substantially basin-shaped container of the regeneration-agent reservoir.

Preferably, though not necessarily, the laundry washing machine is furthermore characterized in that the regeneration-agent reservoir comprises: a storage tank which is structured for being manually fillable with a given quantity of consumable regeneration agent, and which is arranged/located immediately underneath the worktop of the casing, so as to be freely accessible by the user from the worktop of the casing; and a manually-removable cap which is structured to closed the storage tank.

Preferably, though not necessarily, the laundry washing machine is furthermore characterized in that the water supply circuit of the water softening device is structured for channelling the fresh water directly into the storage tank, so as to dissolve the regeneration agents contained into the storage tank and form some brine.

Preferably, though not necessarily, the laundry washing machine is furthermore characterized in that the regeneration-agent reservoir furthermore comprises an overflow drain line which fluidically connects the storage tank to the washing tub or to a waste-water drain line that channels the waste water or washing liquor outside the laundry washing machine, and which is structured for directly channelling the water or brine eventually exceeding the maximum capacity of the storage tank towards the washing tub or towards the waste-water drain line.

Preferably, though not necessarily, the laundry washing machine is furthermore characterized in that the storage tank is recessed/incorporated into the inner shelf of the worktop in a manually removable manner.

Preferably, though not necessarily, the laundry washing machine is furthermore characterized in that the storage tank of the regeneration-agent reservoir is recessed in manually extractable manner into a corresponding tank seat realized on the inner shelf of the worktop, and is provided with at least two self-closing hydraulic connectors which are structured to substantially watertight couple in easily detachable manner with corresponding complementary self-closing hydraulic connectors arranged on the inner shelf; a first self-closing complementary hydraulic connector being in direct communication with a water supply circuit of the internal water softening device; a second complementary self-closing hydraulic connector being in direct communication with the water-softening agent container.

Preferably, though not necessarily, the laundry washing machine is furthermore characterized in that said male self-closing hydraulic connectors are structured to couple with the corresponding complementary self-closing hydraulic connectors arranged on the inner shelf during insertion of the storage tank into the tank seat.

Preferably, though not necessarily, the laundry washing machine is furthermore characterized in that the bottom of the tank seat is shaped/structured so as to form a leakage collector wherein the fresh water or brine leaking out of the storage tank may accumulate; and in that said leakage collector realized on the bottom of said tank seat is connected via a water drain line to the washing tub or to a waste-water drain line that channels the waste water or washing liquor out of the laundry washing machine.

Preferably, though not necessarily, the laundry washing machine is furthermore characterized in that the regeneration-agent reservoir furthermore comprises a water-level sensor which is located on the bottom of the tank seat and is able to measure the level of the fresh water and/or brine accumulated on the leakage collector formed on the bottom of the tank seat.

Preferably, though not necessarily, the laundry washing machine is furthermore characterized in that the water softening device furthermore comprises a water-level sensor which is structured for measuring the level of the fresh water and/or brine contained inside the regeneration-agent reservoir, and/or a salinity-level sensor which is structured for measuring the salinity degree of the brine contained inside the regeneration-agent reservoir.

Preferably, though not necessarily, the laundry washing machine is furthermore characterized by also comprising a water drain line which is structured for selectively rerouting the brine or fresh water coming out from the water-softening agent container directly towards the washing tub or towards a waste-water drain line that channels the waste water or washing liquor out of the laundry washing machine, so as to bypass the detergent dispensing assembly.

BRIEF DESCRIPTION OF THE DRAWINGS

A non-limiting embodiment of the present invention will now be described, by way of example, with reference to the accompanying drawings, in which:

FIG. 9 is a partial and schematic view of a portion of the internal water softening device of the FIG. 7 laundry washing machine; whereas

DETAILED DESCRIPTION OF EXAMPLE EMBODIMENTS

Figure 2:
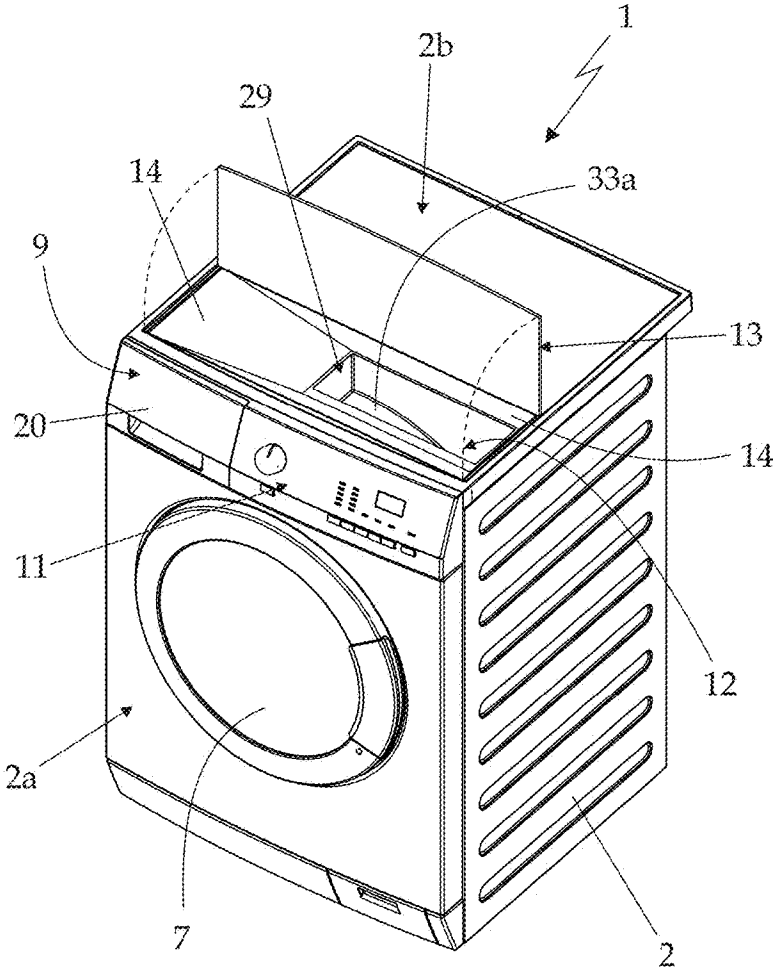
FIG. 2 is a perspective view of the FIG. 1 laundry washing machine in different working configuration.
Figure 1:
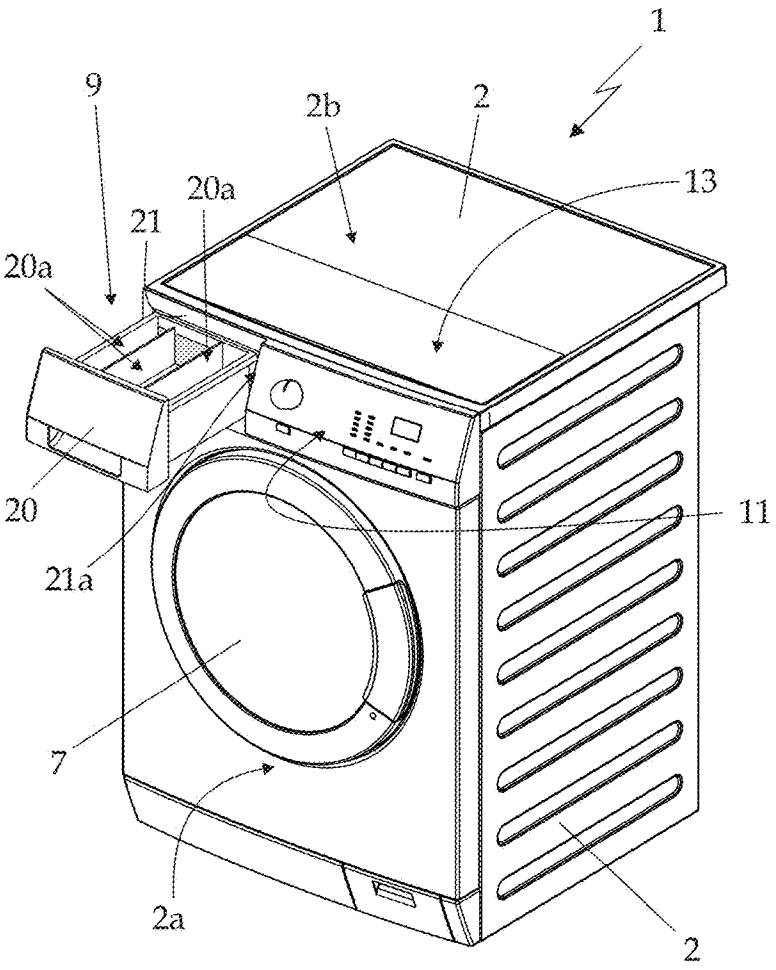
FIG. 1 is a perspective view of a front-loading, home laundry washing machine realized in accordance with the teachings of the present invention.
Figure 3:
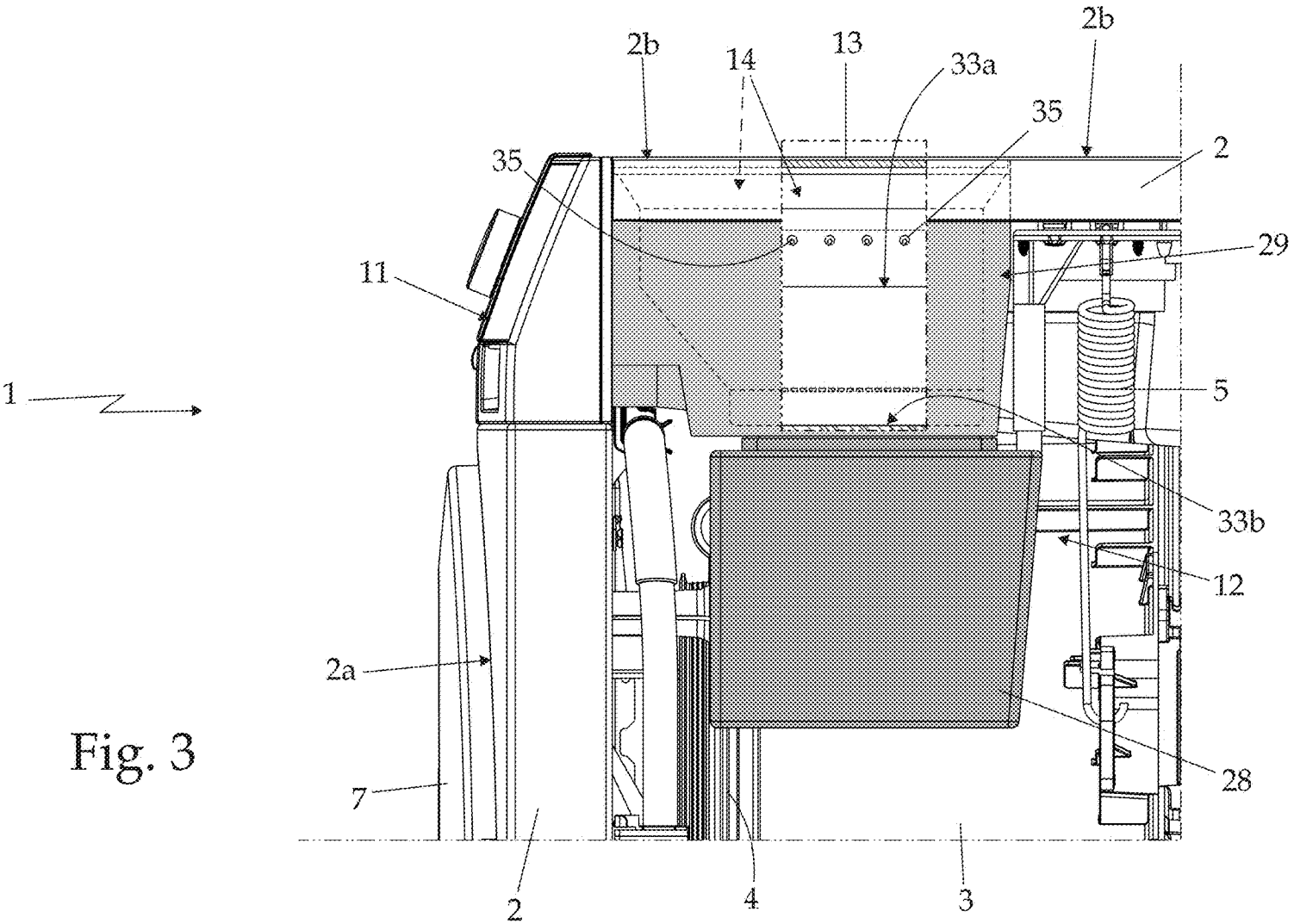
FIG. 3 is a side view of the FIG. 1 laundry washing machine with parts removed for clarity and partly disclosing the internal water softening device of the washing machine.

With reference to FIGS. 1, 2 and 3, reference number 1 indicates as a whole a home laundry washing machine which comprises: a preferably, though not necessarily, substantially parallelepiped-shaped, rigid outer boxlike casing 2 which is structured for resting on the floor; a preferably substantially cylindrical, bell-shaped hollow washing tub 3 which is arranged inside the casing 2 with its opening or mouth directly facing a laundry loading/unloading through opening realized in the front wall 2*a* of boxlike casing 2; a preferably substantially cylindrical, elastically-deformable bellows 4 watertight connecting the front opening or mouth of washing tub 3 to the laundry loading/unloading opening realized in the front wall 2*a* of casing 2; and a substantially cylindrical, bell-shaped rotatable drum (not shown) structured for housing the laundry to be washed, and which is housed in axially rotatable manner inside the washing tub 3, so as to be able to freely rotate about its longitudinal reference axis.

In the example shown, in particular, the laundry loading/unloading opening is preferably realized on front wall 2*a* of casing 2 substantially astride of the vertical center-plane of the casing 2, and the washing tub 3 is preferably arranged inside the boxlike casing 2 with its longitudinal reference axis substantially horizontally-oriented, i.e. substantially perpendicular to front wall 2*a*. The rotatable drum (not shown), in turn, is housed in axially rotating manner inside the washing tub 3 with its front opening directly faced/aligned to the laundry loading/unloading opening on front wall 2*a*, and the drum rotation axis is preferably arranged locally substantially coincident with the substantially horizontally-oriented longitudinal reference axis of washing tub 3.

Furthermore in the example shown the hollow washing tub 3 is preferably suspended in floating manner inside the casing 2 via a suspension system preferably, though not necessarily, comprising a couple of upper coil springs 5 connecting the upper portion of the washing tub 3 to the top of the boxlike casing 2, and a number of lower vibration dampers (not shown) connecting the bottom portion of the washing tub 3 to the bottom of casing 2.

With reference to FIGS. 1, 2, 3 and 4, the laundry washing machine 1 furthermore comprises:

- a porthole door 7 which is hinged to the front wall 2*a* of casing 2 to rotate about a preferably, though not necessarily, vertically-oriented reference axis to and from a closing position in which the peripheral border of the porthole door 7 rests completely on front wall 2*a* for closing the laundry loading/unloading opening and watertight sealing the washing tub 3;
- an electrically-powered motor assembly (not shown) which is structured for driving into rotation the rotatable drum about its longitudinal reference axis inside the washing tub 3;
- a detergent dispensing assembly 9 which is housed inside the casing 2 in easily reachable manner by the user, and is structured for selectively feeding into the washing tub 3, according to the selected washing cycle, a given amount of detergent, softener and/or other washing agent preferably suitably mixed with the fresh water arriving from the water mains, or even simply a given amount of fresh water arriving from the water mains; and
- a fresh-water supply circuit 10 which is connectable to the water mains and is structured for selectively channelling the fresh water from the water mains to the detergent dispensing assembly 9 and/or to the washing tub 3, preferably while controlling/regulating the flow of fresh water towards the detergent dispensing assembly 9 and/or the washing tub 3.

In addition to the above, the laundry washing machine 1 furthermore comprises an appliance control panel 11 which is structured for allowing the user to manually select the desired washing-cycle and is located on front wall 2*a* of casing 2, above the laundry loading/unloading opening and close to a preferably substantially horizontally oriented, upper worktop or top wall 2*b* of the casing 2; and an internal water softening device 12 which is located inside the casing 2, and is structured for selectively reducing, during each washing cycle, the hardness degree of the fresh water flowing from the water mains to the detergent dispensing assembly 9 and/or to the washing tub 3.

With reference to FIGS. 1, 2 and 3, in the examples shown, in particular, the appliance control panel 11 is preferably located on front wall 2*a* of the casing 2 substantially immediately beneath the worktop 2*b* of casing 2, preferably also so as to border the worktop 2*b*. Furthermore the appliance control panel 11 is preferably located substantially on the upper left corner of the front wall 2*a*.

In other words, the appliance control panel 11 is preferably located substantially on the upper region of casing 2.

The internal water softening device 12, in turn, is arranged/located along the fresh-water supply circuit 10, so as to be crossed by the fresh water flowing from the water mains to the detergent dispensing assembly 9 and/or the washing tub 3, and is internally provided with a given amount of water softening agent which is able to reduce the hardens degree of the fresh water flowing through the same water softening device 12, and with a given amount of consumable salt or other regeneration agent which is able to regenerate the water softening function of the water softening agent.

In addition to the above, the water softening device 12 is moreover provided with a loading inlet or mouth which is structured for allowing the user to timely load the consumable salt or other regeneration agent inside the same water softening device 12, and it is arranged/located inside the boxlike casing 2 so that the loading inlet or mouth of the same water softening device 12 is exposed or exposable to the outside on a portion of the worktop 2*b* located behind the appliance control panel 11.

In other words, the exposed or exposable loading inlet or mouth of the water softening device 12 is arranged/located on a portion of the worktop 2*b* extending between the appliance control panel 11 and the back wall of the casing 2.

In the example shown, in particular, the internal water softening device 12 is preferably arranged/located inside the boxlike casing 2 so that the loading inlet or mouth of the same water softening device 12 is exposed or exposable to the outside substantially immediately behind the appliance control panel 11.

In addition to the above, with reference to FIGS. 1 and 2, the loading inlet or mouth of water softening device 12 is preferably freely accessible by the user on the worktop 2*b* through a manually-operated closure assembly 13 preferably arranged/incorporated into the same worktop 2*b*.

In the example shown, in particular, the loading inlet or mouth of water softening device 12 is preferably freely accessible by the user through a manually-operated trapdoor 13 realized on the worktop 2*b* of casing 2 preferably substantially immediately behind the appliance control panel 11.

Preferably the manually-operated trapdoor 13 furthermore forms a portion of the worktop 2*b* of the casing 2.

In other words, the door of the manually-operated trapdoor 13 is preferably movable to and from a closing position wherein the same door hides the loading inlet or mouth of the water softening device 12.

More in details, in the examples shown the door of the manually-operated trapdoor 13 is preferably hinged to the worktop 2*b* of casing 2 so as to be able to rotate about a substantially horizontally-oriented reference axis preferably, though not necessarily, parallel to the reference laying plane of front wall 2*a*, between

- a lowered position (see FIGS. 1 and 3) in which the door of the trapdoor 13 is arranged substantially horizontally and substantially coplanar to the rest of worktop 2*b*, so as to a portion of the worktop 2*b* of the casing 2 and to hide the beneath-located loading inlet or mouth of the water softening device 12; and
- a raised position (see FIG. 2) in which the door of the trapdoor 13 is arranged substantially perpendicular with respect to the rest of the worktop 2*b* so that the loading inlet or mouth of water softening device 12 is freely accessible to the user.

In addition to the above, in the example shown the worktop 2*b* of casing 2 is preferably, though not necessarily, also provided with a substantially-flat, inner shelf or panel 14 which is arranged immediately beneath the manually-operated trapdoor 13, that is to say beneath the manually-operated closure assembly 13, and the loading inlet or mouth of the water softening device 12 is preferably located/incorporated into this substantially-flat inner shelf 14.

The door of the manually-operated trapdoor 13, in turn, is preferably hinged to worktop 2*b* of casing 2 so as to be able to rotate about a substantially horizontally-oriented reference axis preferably, though not necessarily, parallel to the reference laying plane of front wall 2*a*, between a lowered position (see FIGS. 1 and 3) in which the door of the trapdoor 13 rests substantially horizontally above the inner shelf 14, while at same time remaining also substantially coplanar to the rest of worktop 2*b*, so as to hide the shelf 14 and complete the worktop 2*b* of casing 2; and a raised position (see FIG. 2) in which the door of the trapdoor 13 is arranged substantially perpendicular with respect to the rest of the worktop 2*b* so as to make the beneath located shelf 14 freely accessible to the user.

With reference to FIGS. 1 and 2, similarly to the internal water softening device 12, the detergent dispensing assembly 9 is provided with a corresponding loading inlet or mouth which is structured for allowing the user to timely load the requested detergent, softener and/or other washing agent inside the same detergent dispensing assembly 9. However, differently from water softening device 12, the detergent dispensing assembly 9 is preferably arranged/located inside the boxlike casing 2 so that the loading inlet or mouth of the same detergent dispensing assembly 9 is exposed or exposable to the outside on front wall 2*a* of casing 2, preferably above the laundry loading/unloading opening and beneath the worktop 2*b* of the casing 2, i.e. between the worktop 2*b* and the laundry loading/unloading opening.

More specifically, the detergent dispensing assembly 9 is preferably arranged/located inside the casing 2 so that the loading inlet or mouth of the same detergent dispensing assembly 9 is preferably exposed or exposable to the outside on front wall 2*a*, substantially horizontally beside the appliance control panel 11.

In the example shown, in particular, the detergent dispensing assembly 9 is preferably arranged inside the casing 2 so as to locate its loading inlet or mouth immediately beneath the worktop 2*b* of the casing 2, substantially on the upper right corner of front wall 2*a*. Thus the detergent dispensing assembly 9 and the appliance control panel 11 are preferably arranged inside the boxlike casing 2 substantially horizontally aligned to one another, immediately beneath the worktop 2*b* of casing 2.

Figure 4:
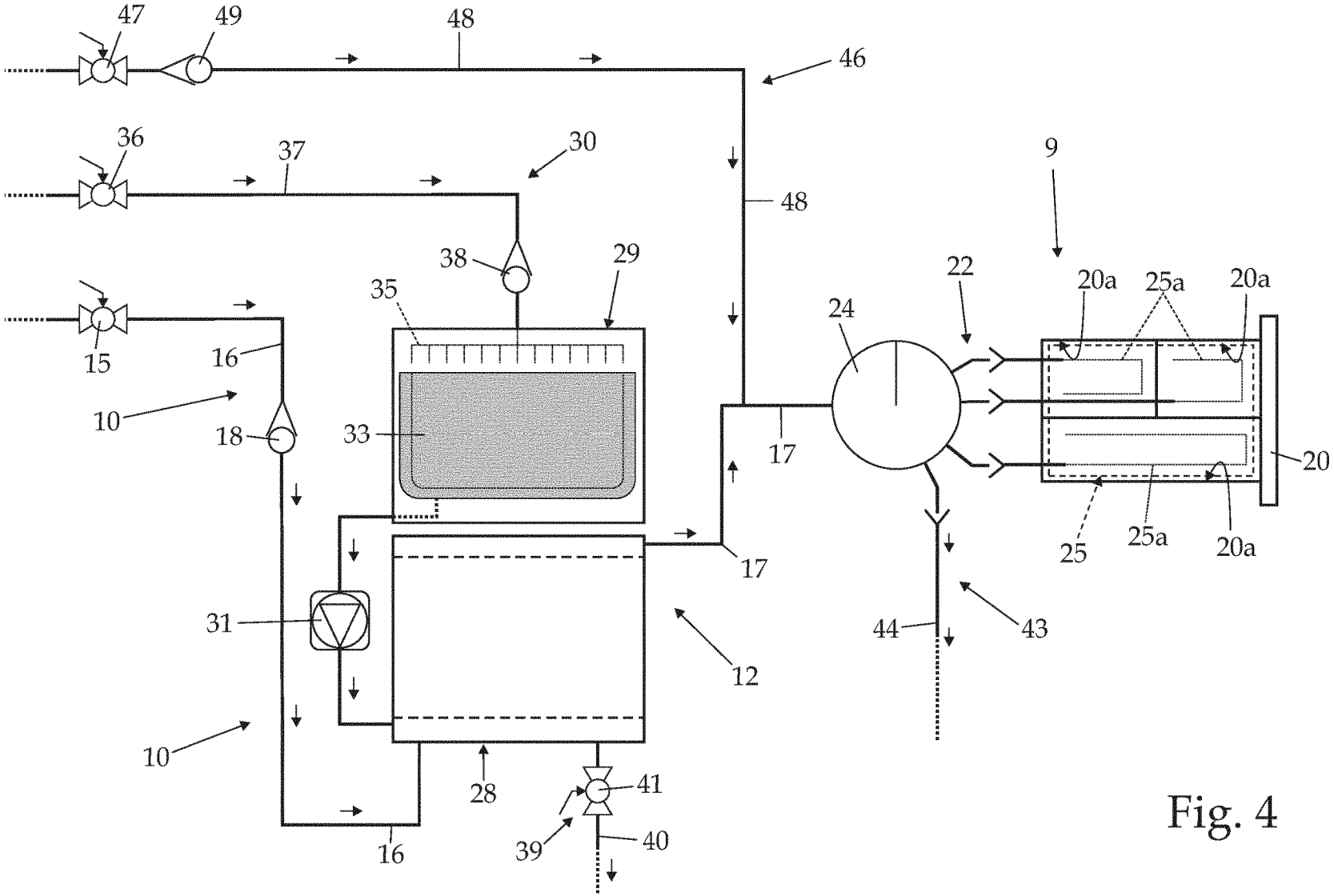
FIG. 4 is a schematic view of the internal water softening device of the FIG. 1 laundry washing machine, with parts removed for clarity.

With reference to FIG. 4, in the example shown the fresh-water supply circuit 10 preferably comprises an electrically-controlled on-off valve 15 which is arranged/interposed between the water mains and the water softening device 12, and is able to control/regulate the flow of fresh water from the water mains towards the water softening device 12; a first pipeline 16 connecting the on-off valve 15 directly to the water inlet of the internal water softening device 12; and a second pipeline 17 connecting the water outlet of the internal water softening device 12 to the detergent dispensing assembly 9 and/or to the washing tub 3.

Furthermore the fresh-water supply circuit 10 is preferably also provided with a one-way valve 18 which is located along pipeline 16 immediately downstream of the on-off valve 15, i.e. between the on-off valve 15 and the water inlet of the water softening device 12, and is structured to allow the fresh water to only flow along the pipeline 16 from the water mains to the water softening device 12 and not vice versa.

The internal water softening device 12 is therefore located downstream of the electrically-controlled on-off valve 15, and also downstream of the one-way valve 18 if present.

With reference to FIGS. 1, 2 and 4, the detergent dispensing assembly 9 instead preferably comprises a detergent container 20 which is manually fillable with a given quantity of detergent, softener and/or other washing agent, and is housed inside the casing 2 into a corresponding container housing 21; and the front wall 2*a* of casing 2 is preferably provided with a corresponding pass-through opening 21*a* through which the detergent container 20 is accessible by the user.

In other words, the detergent container 20 is provided with a loading inlet or mouth which is structured for allowing the user to load the requested detergent, softener and/or other washing agent inside the same detergent container 20, and this loading inlet or mouth is accessible by the user through the pass-through opening 21*a* on front wall 2*a*.

The quantity of detergent, softener and/or other washing agent stored into the detergent container 20 may be sufficient either for a single washing cycle or for several consecutive washing cycles.

In the example shown, in particular, the container housing 21 is preferably located inside casing 2, above the washing tub 3 and beneath the worktop 2*b*, and the pass-through opening 21*a* is preferably arranged/located on front wall 2*a* of casing 2, immediately beneath the worktop 2*b*.

With reference to FIG. 4, preferably, though not necessarily, the detergent dispensing assembly 9 furthermore comprises a water supply circuit 22 which is connected to the fresh-water supply circuit 10 downstream of the water softening device 12, and is structured for selectively channelling a given amount of fresh water arriving from the water mains into the detergent container 20, so as to selectively flush/push a given quantity of the detergent, softener or other washing agent into the washing tub 3.

More specifically, the inlet of water supply circuit 22 is fluidically connected to the fresh-water supply circuit 10, namely to the pipeline 17 of the fresh-water supply circuit 10, so as to receive the fresh water drawn from the water mains, and the water softening device 12 is located upstream of the water supply circuit 22 so as to be crossed by the fresh water flowing towards the water supply circuit 22.

In the example shown, in particular, the detergent dispensing assembly 9 preferably comprises a detergent drawer 20 which is manually fillable with a given quantity of detergent, softener and/or other washing agent, and which is fitted/inserted in manually extractable manner into a completely recessed drawer housing 21 which, starting from front wall 2*a* of casing 2, extends preferably substantially horizontally inside the boxlike casing 2 while remaining above the washing tub 3, and moreover communicates with the outside of casing 2 via a front entrance or opening 21*a* realized on front wall 2*a* of casing 2 substantially immediately above the laundry loading/unloading opening and substantially horizontally beside the appliance control panel 11.

Preferably the bottom of drawer housing 21 is furthermore structured so to directly communicate with the inside of washing tub 3 via a corresponding connecting duct (not shown).

The detergent drawer 20 is therefore manually movable inside the drawer housing 21 in a preferably substantially horizontally-oriented, displacement direction between a working position (see FIG. 2) in which the detergent drawer 20 is completely recessed inside the corresponding drawer housing 21 preferably while at same time closing the front entrance or opening of the same drawer housing, and a completely extracted position (see FIG. 1) in which the detergent drawer 20 partly juts out from the front wall 2*a* of casing 2 through the front entrance or opening 21*a* of the drawer housing 21.

In the example shown, in particular, the drawer housing 21 of detergent drawer 20 is preferably arranged inside casing 2 so as to locate its front entrance or opening 21*a* immediately beneath the worktop 2*b* of casing 2, substantially on the upper right corner of front wall 2*a* of casing 2; whereas the detergent drawer 20 is preferably movable inside the same drawer housing 21 along a substantially horizontally-oriented, displacement direction which is also locally substantially perpendicular to front wall 2*a* of casing 2.

With reference to FIG. 4, the water supply circuit 22, in turn, is connected to the fresh-water supply circuit 10 downstream of the water softening device 12, and is structured for selectively spilling/pouring a given amount of fresh water arriving from the water mains into the detergent drawer 20, so as to selectively flush a given quantity of the detergent, softener or other washing agent into the washing tub 3.

In the example shown, in particular, the water supply circuit 22 receives the fresh water from the fresh-water supply circuit 10, and is preferably structured for selectively spilling/pouring a dense shower of water droplets by gravity directly into the detergent drawer 20, so as to flush the detergent, softener or other washing agent out of the detergent drawer 20 and down onto the bottom of drawer housing 21. This mixture of water and detergent, softener or other washing agent afterwards flows into washing tub 3 via the connecting duct branching off from the bottom of the drawer housing 21 of detergent drawer 20.

In addition to the above, with reference to FIG. 4, the detergent drawer 20 is preferably, though not necessarily, divided into a plurality of detergent compartments 20*a* (three detergent compartments in the example shown) each of which is manually fillable with a respective washing agent; and the water supply circuit 22 is structured for spilling/pouring the softened fresh water arriving from the fresh-water supply circuit 10 selectively and alternatively into any one of the detergent compartments 20*a* of detergent drawer 20, so as to selectively flush the detergent, softener or other washing agent out of the same compartment 20*a* and down onto the substantially funnel-shaped bottom of drawer housing 21 of detergent drawer 20.

With reference to FIG. 4, in the example shown, in particular, the water supply circuit 22 of detergent dispensing assembly 9 is provided with an electrically-controlled hydraulic distributor 24 or similar valve assembly, which is arranged/interposed between the fresh-water supply circuit 10 and the various detergent compartments 20*a* of the detergent drawer 20, i.e. between the outlet of the pipeline 17 and the various detergent compartments 20*a* of detergent drawer 20, and is structured for selectively and alternatively channelling the fresh water arriving from the fresh-water supply circuit 10 towards the various detergent compartments 20*a* of detergent drawer 20.

More specifically, in the example shown the water supply circuit 22 is preferably, though not necessarily, structured for spilling/pouring a dense shower of water droplets by gravity into the various detergent compartments 20*a* of the detergent drawer 20.

In other words, with reference to FIG. 4, in the example shown the water supply circuit 22 preferably comprises a sprinkler head 25 which is associated to the drawer housing 21 of detergent drawer 20 so as to be located immediately above the detergent drawer 20 when the latter is completely inserted/recessed into the drawer housing 21. This sprinkler head 25 is provided with a number (three in the example shown) of shower-making portions/sections 25*a* each of which is preferably substantially vertically aligned to one or more detergent compartments 20*a* of detergent drawer 20, and is structured for feeding a dense shower of water droplets by gravity into said detergent compartment/s 20*a*.

In the example shown, in particular, each shower-making section/portion 25*a* of sprinkler head 25 is preferably locally vertically aligned to a respective detergent compartment 20*a* of detergent drawer 20, and is preferably structured for feeding a dense shower of water droplets exclusively into the detergent compartment 20*a* located immediately beneath.

The electrically-controlled hydraulic distributor or valve assembly 24 is located upstream of the sprinkler head 25, i.e. between the sprinkler head 25 and the fresh-water supply circuit 10, and is structured for channelling the fresh water arriving from the fresh-water supply circuit 10 selectively and alternatively towards the various shower-making sections/portions 25*a* of the sprinkler head 25.

In other words, the electrically-controlled hydraulic distributor 24 is provided with a water inlet fluidically connected to the fresh-water supply circuit 10, i.e. to pipeline 17, and a number (three in the example shown) of water outlets each fluidically connected to a respective shower-making section/portion 25*a* of the sprinkler head 25, and it is structured for selectively and alternatively channelling the fresh water arriving from the fresh-water supply circuit 10 to the various shower-making sections/portions 25*a* of the sprinkler head 25.

With reference to FIGS. 2, 3 and 4, the internal water softening device 12 in turn basically comprises a water-softening agent container 28 and a regeneration-agent reservoir 29, both housed inside the boxlike casing 2.

The water-softening agent container 28 is arranged/located along the fresh-water supply circuit 10 so as to be crossed by the fresh water flowing along the fresh-water supply circuit 10, and is filled with a water softening agent able to reduce the hardness degree of the fresh water flowing through the same water-softening agent container 28. The regeneration-agent reservoir 29 instead is structured for receiving a given quantity of consumable salt or other regeneration agent which is able to regenerate the water softening function of the water softening agents stored inside the water-softening agent container 28, and is fluidically connected to the water-softening agent container 28 for selectively transferring a mixture of water and salt or other regeneration agent to the water-softening agent container 28.

In the example shown, in particular, the water-softening agent container 28 has an inlet connected to pipeline 16 of fresh-water supply circuit 10 and an outlet connected to pipeline 17 of fresh-water supply circuit 10, so as to be crossed by the fresh water flowing from the water mains to the detergent dispensing assembly 9. The water-softening agent container 28 is therefore fluidically interposed between the water mains and the detergent dispensing assembly 9, or more specifically between the water mains and the inlet of the water supply circuit 22 of detergent dispensing assembly 9, so as to be crossed by the fresh water flowing from the water mains to the inlet of water supply circuit 22.

With reference to FIGS. 2, 3 and 4, the regeneration-agent reservoir 29, in turn, is provided with an exposable loading inlet or mouth which is structured for allowing the user to timely load the consumable salt or other regeneration agent inside the same regeneration-agent reservoir 29, thus forming the exposable loading inlet or mouth of the internal water softening device 12, and it is arranged/located inside the casing 2 so that the loading inlet or mouth of the same regeneration-agent reservoir 29 is exposed or exposable to the outside on worktop 2*b* of casing 2, substantially immediately behind the appliance control panel 11.

With reference to FIGS. 3 and 4, in the example shown, in particular, the water-softening agent container 28 is filled with a given amount of ion-exchange resins (not shown) capable to restrain the calcium and/or magnesium ions (Ca++ an Mg++) dissolved in the fresh water flowing across the same water-softening agent container 28, and is located along the fresh-water supply circuit 10 so as to be crossed by the fresh water directed towards the detergent dispensing assembly 9 and/or the washing tub 3.

More in particular, the water-softening agent container 28, hereinafter also referred to as the resin container 28, is preferably arranged between pipelines 16 and 17, so as to be crossed by the fresh water directed towards the detergent dispensing assembly 9 and/or the washing tub 3, and it is furthermore arranged upstream of the hydraulic distributor 24 of detergent dispensing assembly 9, so as to be crossed by the fresh water flowing from the water mains to the inlet of water supply circuit 22. The ion-exchange resins (not shown) stored into the water-softening agent container 28 form the water softening agents of the water softening device 12.

The outside-accessible regeneration-agent reservoir 29, in turn, is structured for receiving a given amount (for example half a Kilo or one Kilo) of salt grains (Sodium Chloride) or similar regeneration chemical agent, and is located/arranged inside the casing 2, immediately beneath the worktop 2*b* of casing 2, so as to be freely accessible by the user through the worktop 2*b* of casing 2, substantially immediately behind the appliance control panel 11.

More specifically, the loading inlet or mouth of the regeneration-agent reservoir 29 is preferably freely accessible by the user through the trapdoor 13 realized on worktop 2*b* of casing 2, substantially immediately behind the appliance control panel 11.

In the example shown, in particular, the regeneration-agent reservoir 29 is preferably arranged immediately underneath the inner shelf 14 of worktop 2*b*, and the loading inlet or mouth of regeneration-agent reservoir 29 is preferably located/incorporated into the inner shelf 14 so as to be freely accessible by the user when the trapdoor 13 is arranged in the raised/opened position.

Furthermore, in the example shown the water-softening agent container 28 is preferably located immediately underneath the regeneration-agent reservoir 29, so as to be substantially vertically aligned to the regeneration-agent reservoir 29 which, in turn, is preferably located immediately beneath the trapdoor 13 realized on worktop 2*b* of boxlike casing 2.

With reference to FIG. 4, in addition to the above the internal water softening device 12 furthermore comprises:

- a water supply circuit 30 which is structured for channelling, on command, a given amount of fresh water into the regeneration-agent reservoir 29 so to at least partly dissolve the salt or other regeneration agents stored therein and form a given amount of brine (i.e. of salt water); and
- an electrically-powered brine-circulating pump 31 which is interposed between the water-softening agent container 28 and the regeneration-agent reservoir 29 and is structured for transferring/moving, when activated, the brine (i.e. the salt water) from the regeneration-agent reservoir 29 to the water-softening agent container 28.

Preferably, the electrically-powered brine-circulating pump 31 is furthermore structured for transferring/moving, when activated, the brine (i.e. the salt water) from the regeneration-agent reservoir 29 to the water-softening agent container 28, and for completely watertight sealing/isolating, when deactivated, the regeneration-agent reservoir 29 from the water-softening agent container 28 so as to prevent the brine (i.e. the salt water) store in the regeneration-agent reservoir 29 from flowing towards the water-softening agent container 28.

Obviously, in a less sophisticated embodiment, the electrically-powered brine-circulating pump 31 may be replaced by an electrically-powered pump assembly comprising a conventional electrically-powered suction pump and an on-off valve which is arranged immediately upstream of the suction pump and is structured to watertight seal the suction/inlet of the electrically-powered suction pump when the latter is deactivated, and to put the suction/inlet of the electrically-powered suction pump in direct communication with the inside of the regeneration-agent reservoir 29 when the suction pump is activated.

Preferably, the water softening device 12 is furthermore provided with a water-level sensor (not shown) which is structured for measuring the level of the brine contained into the regeneration-agent reservoir 29, and/or a salinity-level sensor (not shown) which is structured for measuring the salinity degree of the brine contained into the regeneration-agent reservoir 29.

In the example shown, in particular, the water-level sensor and/or the salinity-level sensor is/are able to communicate with an internal electronic central control unit (not shown) which is housed inside the boxlike casing 2 and controls all electrically-operated component parts of the laundry washing machine 1.

With reference to FIGS. 2, 3 and 4, in the example shown, in particular, the regeneration-agent reservoir 29 preferably comprises a substantially basin-shaped, regeneration-agent container 33 which is manually fillable with a given quantity of consumable salt or other regeneration agent, and is recessed/incorporated into the inner shelf 14 of worktop 2*b*, on a portion of the worktop 2*b* located behind the appliance control panel 11, so that its upper mouth 33*a* is freely accessible by the user when the trapdoor 13 is arranged in the raised position.

More in details, in the example shown the regeneration-agent container 33 is preferably recessed/incorporated into the inner shelf 14 of worktop 2*b*, substantially immediately behind the appliance control panel 1.

The water supply circuit 30, in turn, is structured for channelling, on command, a given amount of fresh water into the basin-shaped container 33 so to at least partly dissolve the salt or other regeneration agents stored therein and form a given amount of brine (i.e. of salt water), and the suction of the brine-circulating pump 31 directly communicates with said regeneration-agent container 33, so that the brine-circulating pump 31 is able to selectively pump the brine from the basin-shaped container 33 to the resin container 28.

Being freely accessible by the user, the upper mouth 33*a* of the basin-shaped container 33 allows the user to load the consumable salt or other regeneration agent inside the regeneration-agent reservoir 29, and therefore forms the exposable loading inlet or mouth of the water softening device 12.

With reference to FIG. 3, in the example shown, in particular, the bottom of the substantially basin-shaped, regeneration-agent container 33 is preferably, though not necessarily, shaped/structured so as to form a gulley or sump 33*b* wherein the brine tends to accumulate, and the suction of the brine-circulating pump 31 directly communicates with said gulley or sump 33*b*, so that the brine-circulating pump 31 is able to selectively pump the brine from the bottom of the basin-shaped container 33 to the resin container 28.

Preferably, though not necessarily, the water softening device 12 furthermore comprises a water-level sensor (not shown) which is structured for measuring the level of the brine contained into the basin-shaped container 33, and/or a salinity-level sensor (not shown) which is structured for measuring the salinity degree of the brine contained into the basin-shaped container 33.

With reference to FIGS. 3 and 4, the water supply circuit 30 of water softening device 12, in turn, is preferably structured for being connected to the water mains independently from the fresh-water supply circuit 10, so as to be able to selectively draw a given amount of fresh water from the water mains and channel said fresh water directly into the regeneration-agent reservoir 29.

In the examples shown, in particular, the water supply circuit 30 is connected to the water mains independently from the fresh-water supply circuit 10, and is preferably structured for spilling/pouring a shower of the water droplets by gravity directly into the basin-shaped container 33.

More in particular, with reference to FIGS. 3 and 4, similarity the water supply circuit 22, the water supply circuit 30 of water softening device 12 preferably comprises:

- a number of sprinkle nozzles 35 which are located on the lateral walls of the basin-shaped container 33, immediately beneath and all around the upper mouth 33*a* of the container 33, and are structured so as to spray a shower of water droplets into the basin-shaped container 33; and
- an electrically-controlled on-off valve 36 which is arranged/interposed between the water mains and the sprinkler nozzles 35, and is able to control/regulate the flow of fresh water from the water mains towards the sprinkler nozzles 35.

In the example shown, in particular, the electrically-controlled on-off valve 36 is preferably, though not necessarily, attached to the rear wall of casing 2 close to on-off valve 15, and it is directly connected to the sprinkler nozzles 35 via a pipeline 37 or the like.

The electrically-controlled on-off valve 36 is furthermore preferably, though not necessarily, dimensioned so as to have a nominal flow rate substantially equal to the nominal flow rate of the brine-circulating pump 31, so that the brine-circulating pump 31 is able to transfer/move the brine little by little from the regeneration-agent reservoir 29 to the resin container 28, thus minimising the permanency of the brine on the bottom of basin-shaped container 33.

As an alternative, the regeneration-agent reservoir 29 may also comprise a manually-removable upper lid which is shaped/structured so as to substantially completely cover and close the upper mouth 33*a* of the basin-shaped container 33; and the water supply circuit 30 of water softening device 12 preferably comprises, in place of the perimetrical sprinkler nozzles 35, a huge sprinkler head which is incorporated into said manually-removable upper lid so as to be faced with the inside of the basin-shaped container 33 when the lid closes the upper mouth 33*a* of the basin-shaped container 33, and is structured for feeding a dense shower of water droplets by gravity into the basin-shaped container 33.

Obviously, the huge sprinkler head may be also incorporated into the trapdoor 13 so as to be vertically aligned to the upper mouth 33*a* of the basin-shaped container 33, when the trapdoor 13 is arranged in the lowered/closed position.

With reference to FIG. 4, preferably, though not necessarily, the water supply circuit 30 of water softening device 12 furthermore comprises an additional one-way valve 38 which is located immediately downstream of the on-off valve 36, i.e. between the on-off valve 37 and the sprinkler nozzles 35, and which is structured to allow the fresh water to only flow along the pipeline 37 from the water mains to the sprinkler nozzles 35.

With reference to FIG. 3, the resin container 28, in turn, is preferably, though not necessarily, attached to the bottom of the substantially basin-shaped, regeneration-agent container 33, immediately beside the upper portion of washing tub 3, so as to internally face the front wall 2*a* of casing 2.

In other words, the resin container 28 is preferably located below the regeneration-agent container 33 located behind the appliance control panel 11, within an approximately triangular pocket seat or compartment delimited by the bottom of the regeneration-agent container 33, the front wall 2*a* of casing 2, the vertical sidewall of the same casing 2, and the upper portion of washing tub 3.

Moreover, the resin container 28 preferably, though not necessarily, consists in a completely stand-alone modular cartridge 28 which is provided with mechanical coupling members (not shown) structured for allowing a rigid and stable, though easily releasable, fastening of the stand-alone modular component-part or cartridge 28 directly to the bottom of the substantially basin-shaped, regeneration-agent container 33, and with hydraulic connectors (not shown) structured for allowing the stable, though easily removable, fluidical connection of the stand-alone modular cartridge 28 to the fresh water supply circuit 10 and to the outlet of the brine-circulating pump 31.

In other words, a first hydraulic connector (not shown) of the stand-alone modular cartridge 28 is connected to pipeline 16, so as to allow the inflow of the fresh water into the resin container 28; a second hydraulic connector (not shown) of the stand-alone modular cartridge 28 is connected to pipeline 17 so as to allow the outflow of the fresh water from the resin container 28 towards the detergent dispensing assembly 9; and a third hydraulic connector (not shown) of the stand-alone modular cartridge 28 is structured to directly communicate with the outlet of the brine-circulating pump 31 so as to allow the controlled inflow of the brine (i.e. the salt water) into the resin container 28.

In addition to the above, with reference to FIG. 4, in the example shown the internal water softening device 12 is preferably, though not necessarily, also provided with a first water drain line 39 which fluidically connects the resin container 28, i.e. the water-softening agent container 28, to the washing tub 3 and is structured for selectively draining the brine or fresh water out of the resin container 28 and channelling said brine or fresh water directly into the washing tub 3.

As an alternative, the water drain line 39 is structured for channelling the brine or fresh water stored into the resin container 28, preferably into the drain sump (not shown) that extends downwards form the bottom of the washing tub 3, or into the water filtering assembly (not shown) that is interposed between the drain sump (not shown) of washing tub 3 and the suction of either the water circulating pump (not shown) or the water exhaust pump (not shown), or substantially directly into the water exhaust pump (not shown) which drains the waste water or washing liquor outside of the laundry washing machine 1, or in any case into the waste-water drain line that channels the waste water or washing liquor outside the laundry washing machine 1.

In the example shown, in particular, the water drain line 39 preferably comprises a pipeline 40 or the like which directly connects the bottom of the resin container 28 to the washing tub 3, or to the drain sump (not shown), or to the water filtering assembly (not shown), or to the water exhaust pump (not shown); and an electrically-controlled on-off valve 41 which is located along the pipeline 40 for controlling the outflow of the brine or fresh water from the resin container 28.

Lastly the internal water softening device 12 is preferably also provided with a water-hardness sensor (not shown) structured for measuring the hardness degree of the fresh water coming out from the resin container 28, i.e. the water-softening agent container 28, directed towards the detergent dispensing assembly 9 or the washing tub 3.

In the example shown, in particular, the water-hardness sensor is able to communicate with an internal electronic central control unit (not shown) which is housed inside the boxlike casing 2 and controls all electrically-operated component parts of the laundry washing machine 1.

Still with reference to FIG. 4, the laundry washing machine 1 is preferably, though not necessarily, also provided with a second water drain line 43 which is structured for selectively rerouting the brine or fresh water coming out from the resin container 28 directed towards the detergent dispensing assembly 9, into the washing tub 3 so as to bypass at least the detergent container 20, i.e. the detergent drawer 20, of the detergent dispensing assembly 9.

As an alternative, the water drain line 43 is structured for channeling the brine or fresh water coming out from the resin container 28 directed towards the detergent dispensing assembly 9, preferably into the drain sump (not shown) that extends downwards form the bottom of washing tub 3, or into the water filtering assembly (not shown) that is interposed between the drain sump (not shown) of washing tub 3 and the suction of the water circulating pump (not shown) and/or of the water exhaust pump (not shown) of the laundry washing machine 1, or in any case into the waste-water drain line that channels the waste water or washing liquor outside the laundry washing machine 1.

In the example shown, in particular, the second water drain line 43 is structured to selectively reroute the brine or fresh water that enters into the detergent dispensing assembly 9 through pipeline 17, directly towards the washing tub 3, or towards the drain sump (not shown) that extends downwards form the bottom of washing tub 3, or towards the water filtering assembly (not shown) that is interposed between the drain sump (not shown) of washing tub 3 and the suction of the water circulating pump (not shown) and/or of the water exhaust pump (not shown) of the laundry washing machine 1, so as to bypass solely the detergent container 20, i.e. the detergent drawer 20, of detergent dispensing assembly 9.

More in particular, with reference to FIG. 4, the second water drain line 43 preferably comprises a pipeline 44 or the like which is connected to a specific additional water outlet of the electrically-controlled hydraulic distributor 24 or similar valve assembly of the detergent dispensing assembly 9, and ends directly into the washing tub 3, or into the drain sump, or into the water filtering assembly, or into the water exhaust pump; and the electrically-controlled hydraulic distributor 24 is structured to selectively direct/channel directly into pipeline 44 the brine of softened fresh water arriving from resin container 28 via pipeline 17, so as to channel the brine or fresh water arriving from resin container 28 directly into the washing tub 3 or into the drain sump (not shown) or into the water filtering assembly (not shown) or into the water exhaust pump (not shown).

In a non-shown alternative embodiment, the second water drain line 43 of fresh-water supply circuit 10 may comprise, immediately upstream of the water supply circuit 22 of detergent dispensing assembly 9, an electrically-controlled three-way valve which has a first outlet connected to the inlet of the water supply circuit 22, i.e. to the hydraulic distributor 24, and a second outlet connected to pipeline 44 of water drain line 43. This electrically-controlled three-way valve is structured for selectively and alternatively channelling the fresh water coming out of the resin container 28 either to pipeline 44, or to the inlet of the water supply circuit 22 of detergent dispensing assembly 9, i.e. to the hydraulic distributor 24.

In this alternative embodiment, therefore, the second water drain line 43 is structured so as to bypass the whole detergent dispensing assembly 9, and therefore the water supply circuit 22 of detergent dispensing assembly 9 may lack the hydraulic distributor 24.

With reference to FIG. 4, preferably the laundry washing machine 1 is finally provided with a second fresh-water supply circuit 46 which is connectable to the water mains independently from the fresh-water supply circuit 10, and which is structured for selectively channelling the fresh water from the water mains to the detergent dispensing assembly 9 and/or directly to the washing tub 3, bypassing the water softening device 12, or better the of the resin container 28 of the water softening device 12.

In other words, the second fresh-water supply circuit 46 connects the water mains directly to the inlet of the water supply circuit 22 of detergent dispensing assembly 9 bypassing the water softening device 12, and is structured so as to selectively channel to the inlet of the water supply circuit 22 a second flow of non-softened fresh water of the water mains. The second fresh-water supply circuit 46 is therefore able to channel the fresh water of the water mains directly towards the inlet of water supply circuit 22 independently from the fresh-water supply circuit 10.

Furthermore, if the second water drain line 43 is present, the second fresh-water supply circuit 46 is preferably, though not necessarily, also able to channel the non-softened fresh water of the water mains directly to the washing tub 3 via the water drain line 43, thus bypassing all detergent compartments 20*a* of the detergent drawer 20.

With reference to FIG. 4, similarly to the fresh-water supply circuit 10, the second fresh-water supply circuit 46 preferably comprises:

- a electrically-controlled on-off valve 47 which is fluidically interposed between the water mains and the inlet of water supply circuit 22 of detergent dispensing assembly 9, and is able to control/regulate the flow of fresh water from the water mains towards the inlet of the water supply circuit 22; and
- a pipeline 48 or the like connecting the on-off valve 47 to the inlet of water supply circuit 22 of detergent dispensing assembly 9 while bypassing the resin container 28.

Furthermore the second fresh-water supply circuit 46 preferably also comprises a second one-way valve 49 which is located downstream of the on-off valve 47, and is structured to allow the fresh water to only flow along the pipeline 48, from the water mains to the inlet of the water supply circuit 20 of detergent dispensing assembly 9, and not vice versa.

Preferably, though not necessarily, the appliance control panel 11 is furthermore structured so as to allow the user to manually select the desired washing cycle between washing cycles that use softened fresh water, washing cycles that use normal, i.e. non-softened, fresh water, and finally washing cycles that use a mixture of softened and normal, i.e. non-softened, fresh water.

General operation of home laundry washing machine 1 is clearly inferable from the above description. When the on-off valve 15 of fresh-water supply circuit 10 is opened the fresh water flows from the water mains to the resin container 28 of internal water softening device 12, wherein the ion-exchange resins reduce the hardness degree of the fresh water directed to the detergent dispensing assembly 9. The water-hardness sensor means monitor the hardness degree of the fresh water directed to the detergent dispensing assembly 9.

After having crossed the resin container 28, the softened fresh water of the water mains reaches the detergent dispensing assembly 9 and enters into the electrically-controlled hydraulic distributor 24 of water supply circuit 22. According to phase of the washing cycle, the hydraulic distributor 24 then channels the softened fresh water to one or more of the shower-making portions/sections 25*a* of the sprinkler head 25 for flushing the detergent, softener or other washing agent out of the corresponding detergent compartment 20*a* of the detergent drawer 20 and sweeping away said detergent, softener or other washing agent down into the washing tub 3 via the connecting duct on the bottom of the drawer housing 21 of detergent drawer 20.

When determines that the ion-exchange resins inside the resin container 28 are no more able to reduce the hardness degree of the fresh water directed to the washing tub 3, the electronic central control unit (not shown) of laundry washing machine 1 performs, preferably immediately before the starting of the rinsing phase of the washing cycle, a regeneration process of the ion-exchange resins stored inside the resin container 28.

Obviously the regeneration process may also take place during the washing phase of the washing cycle, or can take place even when no washing cycle at all is running, preferably on specific request of the user.

At beginning of the regeneration process, the central control unit of laundry washing machine 1 firstly opens the on-off valve 36 of the water supply circuit 30 for enough time to channel into the regeneration-agent reservoir 29, i.e. into the basin-shaped container 33, an amount of fresh water sufficient to form, into the regeneration-agent reservoir 29, the whole amount of brine necessary for the resin regeneration process to take place.

During the preparation of the brine inside the regeneration-agent reservoir 29, the central control unit of laundry washing machine 1 can keep the on-off valve 15 of fresh-water supply circuit 10 either in the closed position or in the opened position according to current phase of the washing cycle.

When the requested amount of brine is formed into the regeneration-agent reservoir 29, the central control unit of laundry washing machine 1 closes the on-off valve 15 of the fresh-water supply circuit 10 to stop the flow of fresh water across the resin container 18, and preferably arranges the hydraulic distributor 24 of detergent dispensing assembly 9 so as to channel the fresh water arriving from the resin container 28 directly into the second water drain line 43.

Afterwards, the central control unit of laundry washing machine 1 activates the brine-circulating pump 31 to transfer/move the whole amount of brine at a time from the regeneration-agent reservoir 29 to the resin container 28. Since the resin container 28 is completely filled with the fresh water of the water mains, the brine entering into the resin container 28 pushes out of the resin container 28 the fresh water previously stored therein. This fresh water flows along pipeline 17 towards the hydraulic distributor 24 which, in turn, directs/channels said fresh water directly into the second water drain line 43.

In the example shown in particular, the brine accumulates on the bottom of the basin-shaped container 33, and the brine-circulating pump 31 sucks the brine from the bottom of the same basin-shaped container 33.

When resin container 28 is completely filled with a sufficient amount of brine, the central control unit of laundry washing machine 1 deactivates the brine-circulating pump 31 to watertight isolate the resin container 28 from the regeneration-agent reservoir 29, and to restrain the brine inside the resin container 28 for a predetermined time interval generally sufficient to allow the brine to remove from the ion-exchange resins the calcium and magnesium ions previously combined/fixed to said resins.

When the regeneration process of the ion-exchange resins is completed, the central control unit of laundry washing machine 1 opens again the on-off valve 15 of fresh-water supply circuit 10, so that the pressurized fresh water of the water mains pushes the brine out of the resin container 28 and into the pipeline 17 which channels the brine towards the hydraulic distributor 24 which, in turn, directs/channels said fresh water directly into the second water drain line 43.

Alternatively, the central control unit of laundry washing machine 1 may open the on-off valve 41 of the first water drain line 39 so to drain the brine out of the resin container 28 through the water drain line 39.

The brine stored in the resin container 28 therefore flows directly into the washing tub 3 or into the drain sump or into the water filtering assembly, or into the water exhaust pump, via the water drain line 39 and/or via the water drain line 43.

Finally, preferably after having closed again the on-off valves 15 and 41, the central control unit of the laundry washing machine 1 activates the water exhaust pump so to discharge the brine out of the laundry washing machine 1 preferably together with the washing or rinsing water already stored on the bottom of the washing tub 3, and continues the washing cycle.

The second fresh-water supply circuit 46, in turn, can channel the fresh water of the water mains towards the inlet of water supply circuit 22 bypassing the water softening device 12, so to channel the non-softened fresh water of the water mains directly towards the inlet of the water supply circuit 22 of detergent dispensing assembly 9. The water supply circuit 22 of detergent dispensing assembly 9 therefore can channel towards any one of the detergent compartments 20*a* of detergent drawer 20, or towards the second water drain line 43 if connected to the hydraulic distributor 24, either softened, non-softened (i.e. normal) fresh water of the water mains or a mixture thereof.

The laundry washing machine 1 is therefore able to use, during each stage of the washing cycle, either softened or non-softened fresh water of the water mains or a mixture thereof. The second fresh-water supply circuit 43, in fact, can channel non-softened fresh water to the inlet of the water supply circuit 22 of detergent dispensing assembly 9 independently from the fresh-water supply circuit 10, thus also at the same time of the fresh-water supply circuit 10.

In a less sophisticated embodiment, however, the electronic central control unit of the laundry washing machine 1 may be programmed to regenerate the ion-exchange resins stored in the resin container 28 after a given number of washing cycles. This number of washing cycles may be decided by the user on the basis of an alleged hardness degree of the fresh water coming out from the water mains.

Obviously in this less sophisticated embodiment the water-hardness sensor means monitor are unnecessary.

Figure 5:
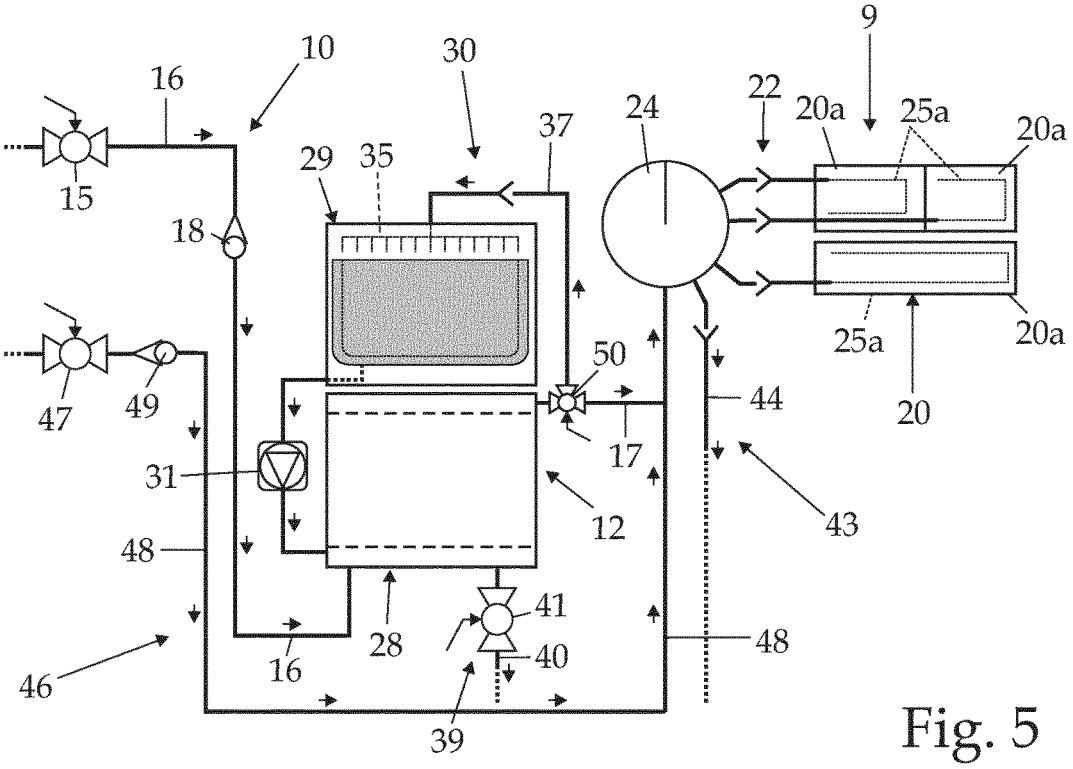
FIG. 5 is a schematic view of a first alternative embodiment of the internal water softening device of the FIG. 1 laundry washing machine.

With reference to FIG. 5, rather than being directly connected to the water mains, in an alternative embodiment of water softening device 12 the water supply circuit 30 preferably branches off from the fresh-water supply circuit 10 downstream of resin container 28, so as to selectively channel into the regeneration-agent reservoir 29 the softened fresh water coming out of resin container 28.

In this embodiment, the water supply circuit 30 lacks the on-off valve 36 and instead comprises an electrically-controlled three-way valve 50 which is arranged along the fresh-water supply circuit 10, downstream of resin container 28, i.e. along the pipeline 17 connecting the outlet of resin container 28 to the inlet of the water supply circuit 22 of detergent dispensing assembly 9.

The pipeline 37 of water supply circuit 30 is now connected to the three-way valve 50, and the electrically-controlled three-way valve 50 is structured for selectively and alternatively channelling the fresh water coming out of the resin container 28, to the sprinkler nozzles 35 for producing the brine, or to the inlet of the water supply circuit 22 of detergent dispensing assembly 9 for performing the washing cycle.

In the FIG. 5 embodiment, at beginning of the regeneration process, the central control unit of laundry washing machine 1 sets the three-way valve 50 of water supply circuit 30 so as to put the outlet of resin container 28 in direct communication with the sprinkler nozzles 35, and afterwards opens the on-off valve 15 of the fresh-water supply circuit 10 for enough time to channel into the regeneration-agent reservoir 29 the whole amount of fresh water necessary to form, on the bottom of the basin-shaped container 33, an amount of brine sufficient for the resin regeneration process to take place. This amount of fresh water obviously flows across the resin container 28 before reaching the regeneration-agent reservoir 29.

Then, after having closed again the on-off valve 15 of the fresh-water supply circuit 10, the central control unit of laundry washing machine 1 sets the three-way valve 50 so as to put again the outlet of resin container 28 in direct communication with the detergent dispensing assembly 9, and afterwards activates the brine-circulating pump 31 to transfer/move the whole amount of brine at a time from the regeneration-agent reservoir 29, i.e. from the bottom of the basin-shaped container 33, to the resin container 28.

When the water-softening agent container 28 is completely filled with a sufficient amount of brine, the central control unit of laundry washing machine 1 deactivates the brine-circulating pump 31 to watertight isolate the resin container 28 from the regeneration-agent reservoir 29.

Figure 6:
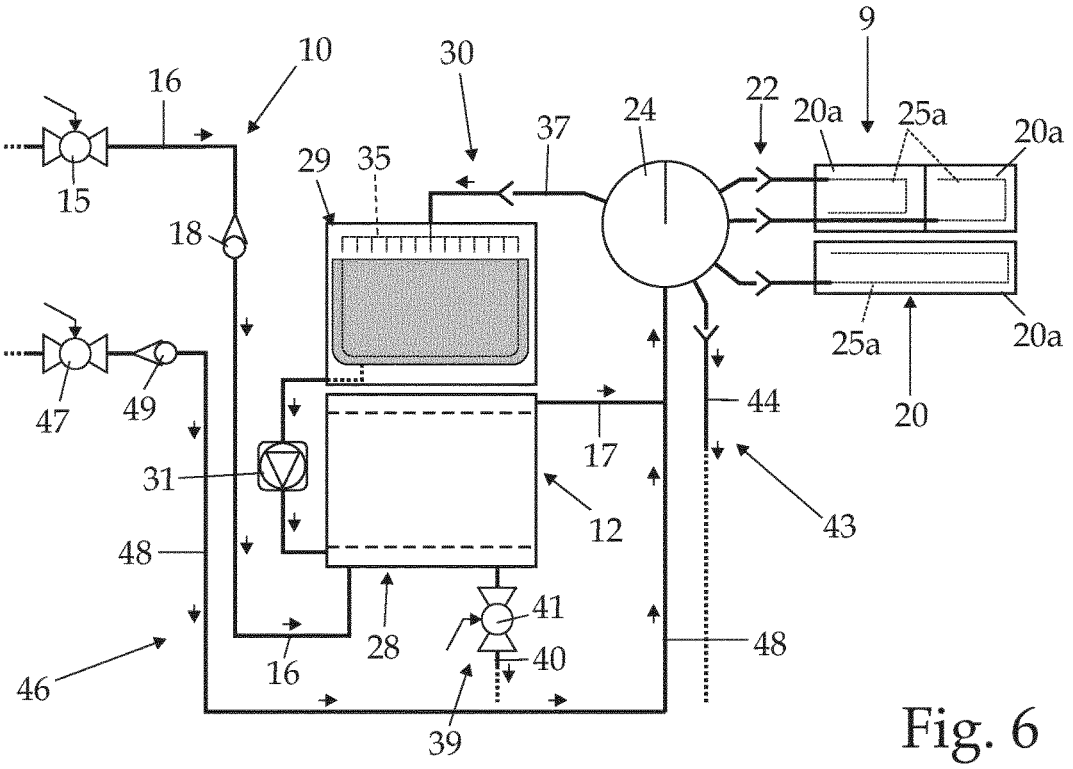
FIG. 6 is a schematic view of a second alternative embodiment of the internal water softening device of the FIG. 1 laundry washing machine.

With reference to FIG. 6, rather than branching off from the fresh-water supply circuit 10 upstream of the detergent dispensing assembly 9, in a second alternative embodiment of the water softening device 12 the water supply circuit 30 preferably branches off from the water supply circuit 22 of detergent dispensing assembly 9, so as to selectively channel into the regeneration-agent reservoir 29 the softened fresh water entering into the detergent dispensing assembly 9.

In other words, the water supply circuit 30 lacks the on-off valve 36 and the pipeline 37 of water supply circuit 30 is now connected to a specific additional water outlet of the electrically-controlled hydraulic distributor 24 of water supply circuit 22, and the electrically-controlled hydraulic distributor 24 is structured to selectively direct/channel into pipeline 37 the softened fresh water or brine arriving from resin container 28 via pipeline 17.

In this embodiment, at beginning of the regeneration process, the central control unit of laundry washing machine 1 firstly arranges the hydraulic distributor 24 so as to channel towards the water supply circuit 30 the fresh water that arrives to the hydraulic distributor 24 from the resin container 28, and afterwards it opens the on-off valve 15 for enough time to channel into the regeneration-agent reservoir 29, the whole amount of fresh water necessary to form, on the bottom of the basin-shaped container 33, an amount of brine sufficient for the resin regeneration process to take place. This amount of fresh water obviously flows across the resin container 28 and the hydraulic distributor 24 of detergent dispensing assembly 9 before reaching the regeneration-agent reservoir 29.

Then, after having closed the on-off valve 15, the central control unit of laundry washing machine 1 sets/arranges the hydraulic distributor 24 of water supply circuit 22 so as to put the outlet of resin container 28 in communication with the second water drain line 43, and afterwards activates the brine-circulating pump 31 to transfer/move the whole amount of brine at a time from the regeneration-agent reservoir 29, i.e. from the bottom of the basin-shaped container 33, to the resin container 28.

When the water-softening agent container 28 is completely filled with a sufficient amount of brine, the central control unit of laundry washing machine 1 deactivates the brine-circulating pump 31 to watertight isolate the resin container 28 from the regeneration-agent reservoir 29.

The advantages resulting from the arrangement of the regeneration-agent reservoir 29 of the water softening device 12 beneath the worktop **2*b* of casing 2, immediately behind the appliance control panel 11, are really remarkable. Firstly the arrangement of the regeneration-agent reservoir 29 immediately beneath the worktop 2*b* of the casing 2 on the opposite side of the washing tub 3 respect to the detergent dispensing assembly 9, behind the appliance control panel 11, allows to significantly increase the capacity of the regeneration-agent reservoir 29. The space on the back of the appliance control panel 11**, in fact, is generally empty, i.e. unused, even if relatively roomy.

As a result the user is requested to fill up the regeneration-agent reservoir 29 less frequently.

Furthermore the arrangement of the exposable loading inlet or mouth of the regeneration-agent reservoir 29 on the worktop **2*b* of casing 2, immediately underneath a manually-operated trapdoor 13 provided on worktop 2*b* of casing 2, makes the refilling of the regeneration-agent reservoir 29** very user-friendly.

The second fresh-water supply circuit 46 bypassing the internal water softening device 12, instead, allows to improve the working flexibility of the laundry washing machine 1. During pre-wash or rinse phases of the washing cycle, when detergent agents are usually not required, the laundry washing machine 1 can use normal fresh water, thus lengthening the time between the regenerations of the ion-exchange resins. In view of that, the appliance control panel 11 may be structured so as to allow the user to manually select washing cycles that use softened fresh water, washing cycles that use normal, i.e. non-softened, fresh water, and finally washing cycles that use a mixture of softened and normal, i.e. non-softened, fresh water.

Clearly, changes may be made to the front-loading laundry washing machine 1 as described above without, however, departing from the scope of the present invention.

Figure 7:
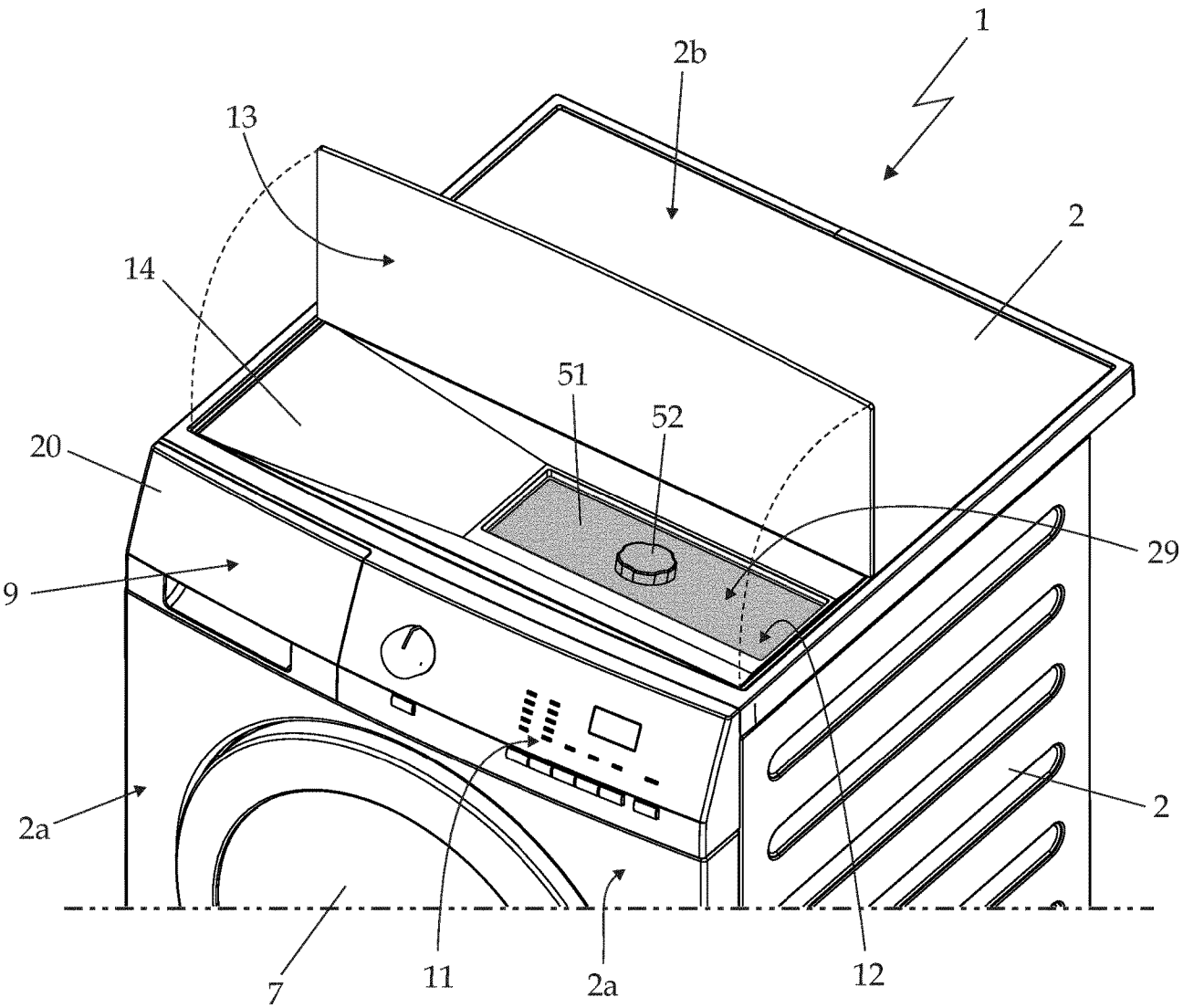
FIG. 7 is a perspective view of a second embodiment of the FIG. 1 laundry washing machine.
Figure 8:
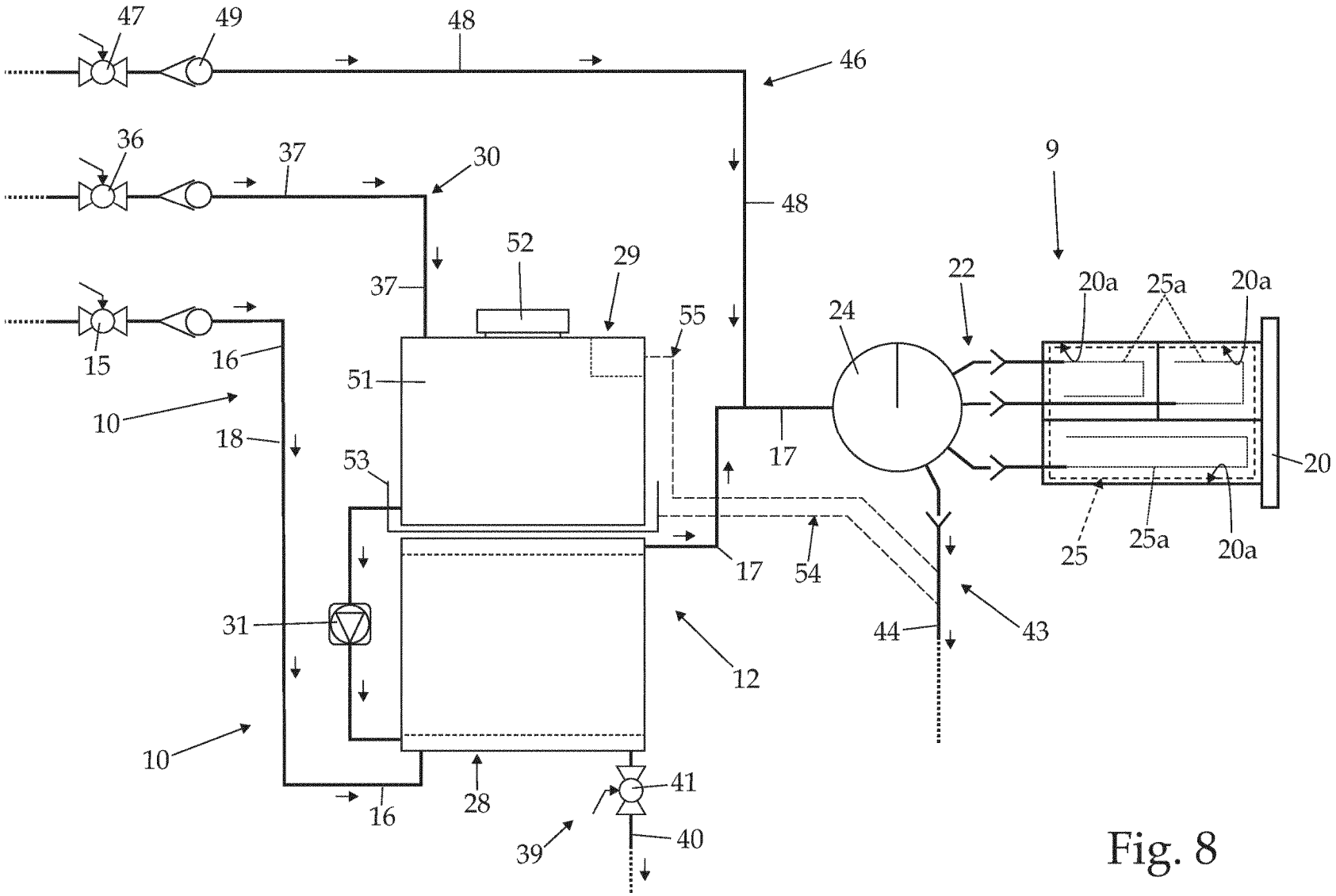
FIG. 8 is a schematic view of the internal water softening device of the FIG. 7 laundry washing machine, with parts removed for clarity.
Figure 9:
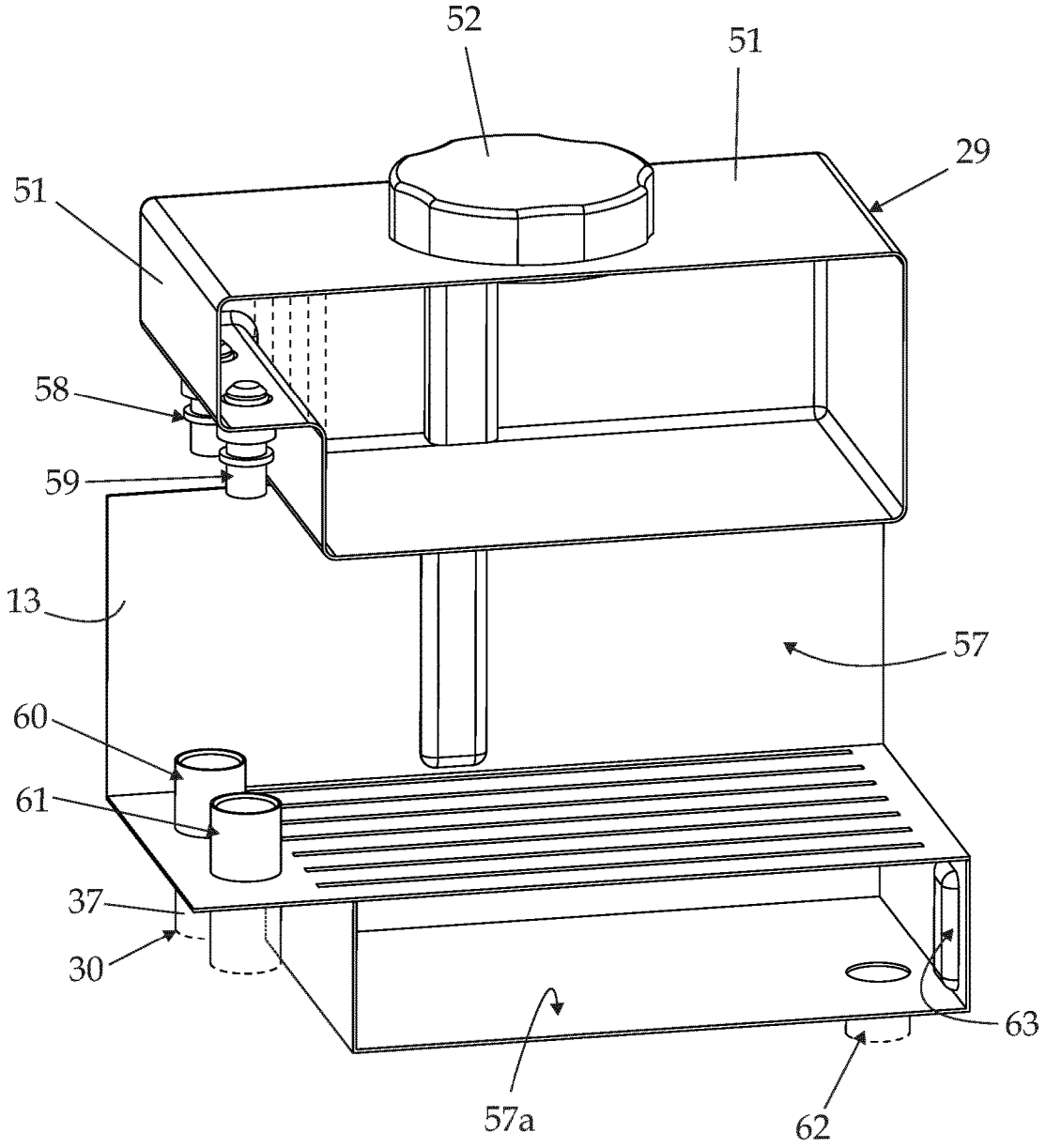

For example, with reference to FIGS. 7, 8 and 9, according to a more sophisticated embodiment of water softening device 12, the regeneration-agent reservoir 29 comprises: a preferably substantially parallelepiped-shaped, storage tank 51 which is structured for being manually fillable with a given quantity of consumable salt or other regeneration agent, and which is arranged/located immediately underneath the worktop 2*b* of casing 2 on a portion of the worktop 2*b* arranged behind the appliance control panel 11, so as to be freely accessible by the user from worktop 2*b* of casing 2 preferably through the manually-operated trapdoor or similar closure assembly 13 realized on the worktop 2*b* of casing 2; and a manually-removable cap 52 which is structured to close the storage tank 51, and is preferably located on top of storage tank 51 so as to be freely accessible by the user.

In the example shown, in particular, the storage tank 51 is preferably arranged/located immediately underneath the worktop 2*b* of casing 2, preferably substantially immediately behind the appliance control panel 11, so that at least the manually removable cap 52 of storage tank 51 is freely accessible by the user when the trapdoor or similar manually-operated closure assembly 13 is arranged in the raised/opened position (see FIG. 7), and is completely hidden and inaccessible by the user when the trapdoor or closure assembly 13 is arranged in the lowered/ closed position.

Being freely accessible by the user when the trapdoor 13 is arranged in the raised position, the manually-removable cap 52 allows the user to easily load the consumable salt or other regeneration agent inside the regeneration-agent reservoir 29, and therefore forms the exposable loading inlet or mouth of the water softening device 12.

The water supply circuit 30 of water softening device 12, in turn, is preferably structured for channelling, on command, a given amount of fresh water from the water mains directly into the storage tank 51, so as to preferably completely dissolve at once the whole salt or other regeneration agents contained into storage tank 51 and form a great amount of brine (i.e. of salt water).

In this alternative embodiment, moreover, the water supply circuit 30 of water softening device 12 is preferably no more provided with the sprinkler nozzles 35, and the pipeline 37 directly connects the electrically-controlled on-off valve 36 to storage tank 51.

Obviously, the water supply circuit 30 of water softening device 12 may also branch off from the fresh-water supply circuit 10 upstream of the detergent dispensing assembly 9 as disclosed in FIG. 5, or may branch off from the water supply circuit 22 of detergent dispensing assembly 9 as disclosed in FIG. 6, so as to selectively channel into the regeneration-agent reservoir 29 the softened fresh water entering into the detergent dispensing assembly 9.

With reference to FIG. 8, the electrically-powered brine-circulating pump 31, in turn, is structured for selectively and alternatively sucking the brine (i.e. the salt water) from the storage tank 51 and delivery it to the water-softening agent container 28, or completely watertight sealing/isolating the storage tank 51 from the water-softening agent container 28, so as to prevent the brine (i.e. the salt water) contained into the storage tank 51 from flowing towards the water-softening agent container 28.

Again, the water softening device 12 preferably furthermore comprises a water-level sensor (not shown) which is structured for measuring the level of the fresh water and/or brine contained inside the storage tank 51, and/or a salinity-level sensor (not shown) which is structured for measuring the salinity degree of the brine contained inside the storage tank 51.

Moreover, in the example shown the storage tank 51 is preferably recessed/incorporated, either in a manually removable or unmovable manner, into the substantially-flat inner shelf 14 located beneath the manually-operated trapdoor 13, and is moreover dimensioned to contain an amount of brine sufficient for performing several resin regeneration processes. Furthermore the storage tank 51 is arranged into the substantially-flat inner shelf 14 substantially immediately behind the appliance control panel 11, so that at least the manually-removable cap 52 of storage tank 51 is freely accessible by the user when the trapdoor 13 is arranged in the raised position (see FIG. 7), and is completely hidden and inaccessible by the user when the trapdoor 13 is arranged in the lowered position.

More in particular, with reference to FIG. 8, the storage tank 51 of regeneration-agent reservoir 29 is preferably unmovably recessed/housed into the substantially-flat inner shelf 14, and the water softening device 12 is preferably provided with a preferably substantially basin-shaped, leakage collector 53 which is realized on the substantially-flat inner shelf 14 or on the worktop 2*b* so as collect the brine or water accidentally coming out from the storage tank 51 during refilling of the consumable salt.

Preferably the water softening device 12 is furthermore provided with a third water drain line 54 which fluidically connects the leakage collector 53 on the inner shelf 14 or worktop 2*b* to the washing tub 3, and is structured to directly channel the water or brine accumulating into the leakage collector 53 towards the washing tub 3.

As an alternative, the water drain line 54 may be structured for channeling the brine or fresh water accumulating into the leakage collector 53 preferably into the drain sump (not shown) that extends downwards form the bottom of the washing tub 3, or into the water filtering assembly (not shown) that is interposed between the drain sump (not shown) of washing tub 3 and the suction of either the water circulating pump (not shown) or the water exhaust pump (not shown), or substantially directly into the water exhaust pump (not shown) which drains the waste water or washing liquor outside of the laundry washing machine 1, or in any case into the waste-water drain line that channels the waste water or washing liquor outside the laundry washing machine 1.

Preferably, though not necessarily, the regeneration-agent reservoir 29 furthermore comprises, in addition or alternatively to the drain line 54, an overflow drain line 55 which fluidically connects the storage tank 51 to the washing tub 3, and is structured for directly channelling the water or brine eventually exceeding the maximum capacity of the storage tank 51 towards the washing tub 3.

Obviously the overflow drain line 55 may alternatively be structured to channel the water or brine eventually exceeding the maximum capacity of the storage tank 51 towards the drain sump, or towards the water filtering assembly, or towards the water exhaust pump, or in any case towards the waste-water drain line that channels the waste water or washing liquor outside the laundry washing machine 1.

With reference to FIG. 9, according to an alternative embodiment, the regeneration-agent reservoir 29 is housed in manually removable manner into the boxlike casing 2. Thus the storage tank 51 is preferably recessed in manually extractable manner into a corresponding preferably substantially basin-shaped, complementary tank seat 57 realized on the inner shelf 14 located beneath the manually-operated trapdoor 13, behind the appliance control panel 11, and is preferably provided with two self-closing hydraulic connectors 58 and 59 which are structured to hydraulically connect the storage tank 51 in easily detachable manner to, respectively, the water supply circuit 30 and the suction of the brine-circulating pump 31, preferably during insertion of the storage tank 51 into the tank seat 57.

More in particular, each self-closing hydraulic connector 58, 59 of storage tank 51 is specifically structured to watertight couple in easily detachable manner with a corresponding complementary, preferably self-closing, hydraulic connector 60, 61 arranged on the inner shelf 14 of worktop 2*b*.

The self-closing hydraulic connector 60 directly communicates with the water supply circuit 30 of water softening device 12 and, when suitably coupled to the self-closing hydraulic connector 58, allows the fresh water arriving from water supply circuit 30 to freely flow into storage tank 51.

The self-closing hydraulic connector 61, in turn, directly communicates with the suction of the brine-circulating pump 31, and allows, when suitably coupled to the self-closing hydraulic connector 59, the brine stored into the storage tank 51 to freely flow out of the storage tank 51 towards the brine-circulating pump 31.

Each self-closing hydraulic connector 58, 59 of storage tank 51 is furthermore structured so as to remain closed in watertight manner when uncoupled from the corresponding complementary self-closing hydraulic connector 60, 61 of the drawer-like supporting structure 13. Similarly each self-closing hydraulic connector 60, 61 of drawer-like supporting structure 13 is preferably structured so as to remain closed in watertight manner when uncoupled from the corresponding complementary self-closing hydraulic connector 58, 59 of storage tank 51.

With reference to FIG. 9, in the example shown, in particular, the storage tank 51 of the regeneration-agent reservoir 29 is preferably structured so as to be vertically insertable into the tank seat 57 realized on the inner shelf 14 of worktop 2*b* when the trapdoor 13 is arranged in the raised position (see FIG. 7). The self-closing hydraulic connectors 60 and 61, in turn, are preferably arranged inside the tank seat 57, preferably on the bottom of the same tank seat 57.

Furthermore the bottom 57*a* of tank seat 57 is preferably, though not necessarily, shaped/ structured so as to form a catchment basin or similar leakage collector wherein the fresh water or brine leaking out of the storage tank 51 may accumulate. This catchment basin or similar leakage collector, in turn, is preferably connected to the bottom of washing tub 3 via a corresponding water drain line 62.

As an alternative, the water drain line 62 may be structured for channelling the brine or fresh water accumulating on the bottom 57*a* of tank seat 57 preferably into the drain sump (not shown) that extends downwards form the bottom of washing tub 3, or into the water filtering assembly (not shown) that is interposed between the drain sump (not shown) of washing tub 3 and the suction of the water circulating pump (not shown) and/or of the water exhaust pump (not shown) of the laundry washing machine 1, or in any case into the waste-water drain line that channels the waste water or washing liquor outside the laundry washing machine 1.

With reference to FIG. 9, the regeneration-agent reservoir 29 is preferably also provided with a second water-level sensor 63 which is located on the bottom of tank seat 57 and is able to measure the level of the fresh water and/or brine accumulated on the catchment basin formed on the bottom of tank seat 57, and the electronic central control unit (not shown) of the laundry washing machine 1 activates the water drain line 62 when the level of brine and/or fresh water on the bottom of tank seat 57 exceeds a given threshold value.

Operation of the FIG. 8 water softening device 12 is slightly different from that of FIG. 4, 5 or 6. In this embodiment, in fact, the central control unit of laundry washing machine 1 is preferably no more requested to channel the requested amount of fresh water into the regeneration-agent reservoir 29 at beginning of each regeneration process.

In the FIG. 9 embodiment, in fact, the central control unit of laundry washing machine 1 can open the on-off valve 36 of water supply circuit 30 for a predetermined time interval at any time before the beginning of the regeneration process, so as to completely fill up the storage tank 51 with fresh water.

Since the electrically-powered brine-circulating pump 31 is still configured so as to completely watertight seal/isolate the storage tank 51 from the water-softening agent container 28, the entry of fresh water into the storage tank 51 may naturally stop before the subsequent closing of the on-off valve 36, when the storage tank 51 is completely full of water.

The fresh water channelled into storage tank 51 preferably dissolves the whole salt contained into the storage tank 51 and forms a great amount of brine (i.e. of salt water) sufficient for performing several resin regeneration processes. This great amount of brine remains inside the storage tank 51 until a resin regeneration process is requested to take place.

Thus, assuming that the storage tank 51 already contains a given amount of brine sufficient for performing one or more resin regeneration processes and that the on-off valve 36 is closed, at beginning of the regeneration process the central control unit of laundry washing machine 1 closes the on-off valve 15 of the fresh-water supply circuit 10 to stop the flow of fresh water across the resin container 18, and preferably arranges the hydraulic distributor 24 of detergent dispensing assembly 9 so as to channel the fresh water arriving from the resin container 28 directly into the second water drain line 43.

Afterwards, the central control unit of laundry washing machine 1 activates the brine-circulating pump 31 to move/ pump the requested amount of brine from the storage tank 51 of the regeneration-agent reservoir 29 to the resin container 28.

If, at any time during pumping of the brine, the central control unit of laundry washing machine 1 determines that the level of the brine inside the storage tank 51 is too low, it may temporarily open again the on-off valve 36 to channel some more fresh water into the storage tank 51 via the water supply circuit 30.

When the resin container 28 is completely filled with a sufficient amount of brine, the central control unit of laundry washing machine 1 switches off the electrically-powered brine-circulating pump 31 to stop the movement of the brine from the storage tank 51 to the resin container 28, so as to watertight isolate the resin container 28 from the regeneration-agent reservoir 29.

The central control unit of laundry washing machine 1 then keeps the resin container 28 completely full of brine for a predetermined time interval generally sufficient to allow the brine contained into the resin container 28 to remove from the ion-exchange resins the calcium and magnesium ions previously combined/fixed to said resins.

When the regeneration process of the ion-exchange resins is completed, the central control unit of laundry washing machine 1 opens again the on-off valve 15 of fresh-water supply circuit 10, so that the pressurized fresh water of the water mains can push the brine out of the resin container 28.

Operation of the FIGS. 7, 8 and 9 embodiment of laundry washing machine 1 then continues as disclosed with reference to FIG. 4, 5 or 6 according to the layout of the water supply circuit 30, with the difference that some brine remains stored inside the storage tank 51, ready for being used in the next resin regeneration process.

Figure 10:
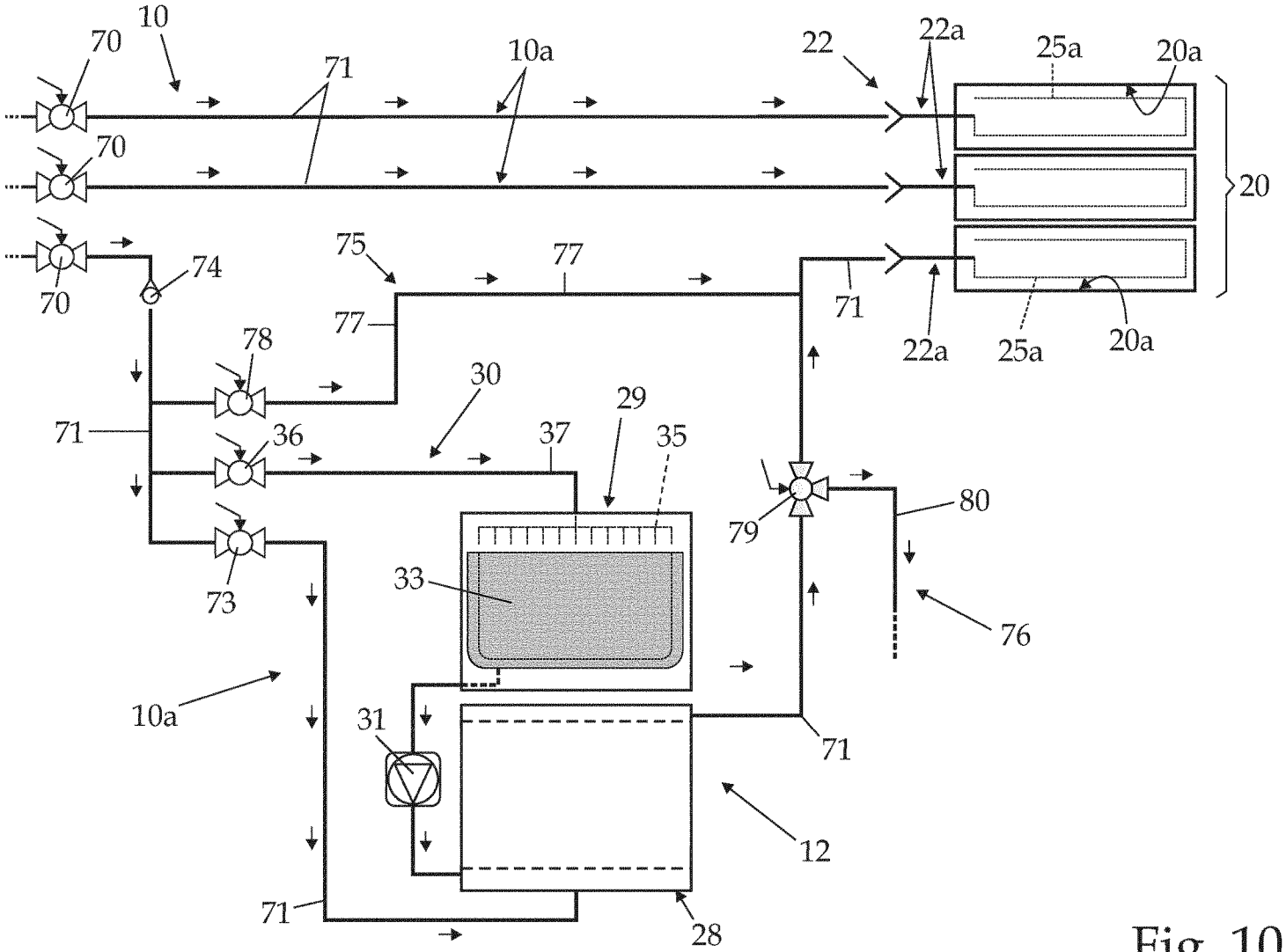
FIG. 10 is a schematic view of an alternative embodiment of the internal water softening device of the FIG. 7 laundry washing machine.

With reference to FIG. 10, in a second cost-saving alternative embodiment of the laundry washing machine 1, the fresh-water supply circuit 10 preferably comprises a plurality of independent fresh-water supply lines 10*a*, each of which is independently connected to the water mains and is structured for selectively channelling the fresh water from the water mains directly to a corresponding detergent compartment 20*a* of the detergent drawer 20; and the water softening device 12 is located along the fresh-water supply line 10*a* that channels the fresh water of the water mains towards the detergent compartment 20*a* structured for containing the amount of detergent or other washing agent to be used in the main-wash phase of the washing cycle.

The water supply circuit 22 of the detergent dispensing assembly 9, in turn, is divided into a plurality of independent water supply lines 22*a*, each of which is directly connected to a corresponding fresh-water supply line 10*a* of the fresh-water supply circuit 10, and is structured for channelling the fresh water arriving from the corresponding fresh-water supply line 10*a* exclusively to a corresponding detergent compartment 20*a* of the detergent drawer 20.

In the example shown, in particular, the detergent drawer 20 is preferably provided with three detergent compartments 20*a* which are structured for respectively containing the amount of detergent or other washing agent to be used in the main-wash phase of the washing cycle, the amount of detergent or other washing agent to be used in the pre-wash phase of the washing cycle, and finally the amount of softener, stain-remover or other washing agent to be used in the final-wash phase of the washing cycle; whereas the fresh-water supply circuit 10 is preferably provided with three independent fresh-water supply lines 10*a*, each of which is independently connected to the water mains and is structured for selectively channelling the fresh water towards a corresponding detergent compartment 20*a* of the detergent drawer 20.

More specifically, each independent water supply line 22*a* of the water supply circuit 22 is preferably structured so as to directly connect a corresponding fresh-water supply line 10*a* of the fresh-water supply circuit 10 to a corresponding shower-making portion/section 25*a* of sprinkler head 25 located above a corresponding detergent compartment 20*a* of detergent drawer 20.

With reference to FIG. 10, in the example shown, in particular, each fresh-water supply line 10*a* of the fresh-water supply circuit 10 preferably comprises an electrically-controlled on-off valve 70 which is interposed between the water mains and the corresponding water supply line 22*a* of the water supply circuit 22, and is able to control/regulate the flow of fresh water from the water mains towards said water supply line 22*a;* and a pipeline 71 directly connecting said on-off valve 70 to the corresponding water supply line 22*a* of water supply circuit 22 of detergent dispensing assembly 9.

Similarly to the previous embodiments, the water softening device 12 is still provided with the water-softening agent container 28 and with the regeneration-agent reservoir 29, both housed inside the casing 2. In this case, however, the water-softening agent container 28 is located along the fresh-water supply line 10*a* that channels the fresh water of the water mains towards the detergent compartment 20*a* structured for containing the amount of detergent or other washing agent to be used in the main-wash phase of the washing cycle.

More in particular, in the example shown the water-softening agent container 28 is preferably arranged along the pipeline 71 of the fresh-water supply line 10*a* that channels the fresh water of the water mains towards the water supply line 22*a* of detergent dispensing assembly 9 that ends in the shower-making portion/section 25*a* of sprinkler head 25 located immediately above the detergent compartment 20*a* structured for containing the amount of detergent or other washing agent to be used in the main-wash phase of the washing cycle.

Similarly to FIGS. 1 to 6 embodiment, the regeneration-agent reservoir 29 is still located immediately beneath the worktop 2*b* of casing 2 and behind the appliance control panel 11, so as to be freely accessible by the user from worktop 2*b* of casing 2, preferably through the manually-operated trapdoor or similar closure assembly 13 realized on worktop 2*b* of casing 2. Again the regeneration-agent reservoir 29 preferably furthermore comprises a substantially basin-shaped, regeneration-agent container 33 which is manually fillable with a given quantity of consumable salt or other regeneration agent, and is preferably recessed/incorporated into the inner shelf 14 of worktop 2*b*, so that the upper mouth 33*a* of the basin-shaped container 33 is freely accessible by the user when the manually-operated trapdoor 13 is arranged in the raised position (see FIGS. 2 and 3), and is completely hidden and inaccessible by the user when the manually-operated trapdoor 13 is arranged in the lowered position (see FIG. 1).

Obviously, alternatively the regeneration-agent reservoir 29 may comprise: a storage tank 51 which is structured for being manually fillable with a given quantity of consumable salt or other regeneration agent, and is recessed/incorporated into the inner shelf 14 of worktop 2*b* either in unmovable or manually removable manner; and the manually-removable cap 52 which is structured to closed the storage tank 51.

With reference to FIG. 10, in this embodiment the internal water softening device 12 furthermore comprises an auxiliary electrically-controlled on-off valve 73 which is located along the fresh-water supply line 10*a* that channels the fresh water of the water mains towards the detergent compartment 20*a* structured for containing the amount of detergent or other washing agent to be used in the main-wash phase of the washing cycle, immediately upstream of the water-softening agent container 28, so as to be able to selectively and alternatively allow or prevent the flow of fresh water from the water mains towards the water-softening agent container 28; and the water supply circuit 30 branches off from the fresh-water supply line 10*a* immediately upstream of the auxiliary on-off valve 73, so as to selectively channel into the storage tank 51 the fresh water that flows along the fresh-water supply line 10*a*.

In the example shown, in particular, the pipeline 37 of water supply circuit 30 preferably branches off from pipeline 71 of fresh-water supply line 10*a* downstream of the on-off valve 70 and upstream of the auxiliary on-off valve 73, and ends into the sprinkle nozzles 35 on the lateral walls of the basin-shaped container 33 (or directly into the storage tank 51 if a storage tank 51 is used); and the on-off valve 36 of water supply circuit 30 is preferably located/arranged along pipeline 37, so as to control/regulate the flow of fresh water that flows from the pipeline 71 of fresh-water supply line 10*a* to the regeneration-agent reservoir 29.

Preferably, the internal water softening device 12 furthermore comprises a one-way valve 74 which is located immediately downstream of the on-off valve 70 of the fresh-water supply line 10*a,* i.e. between the on-off valve 70 and the on-off valve 73, and is arranged so to allow the fresh water to only flow along the pipeline 71, from the water mains to the water softening device 12 and not vice versa; and the water supply circuit 30 branches off from the fresh-water supply line 10*a* downstream of the one-way valve 74.

With reference to FIG. 10, the internal water softening device 12 preferably finally comprises a water by-pass circuit 75 and optionally also an auxiliary water drain line 76.

The water by-pass circuit 75 preferably branches off from the fresh-water supply line 10*a* upstream of the auxiliary on-off valve 73 and downstream of the on-off valve 70, or the one-way valve 74 if present, and is structured to selectively redirect/channel the fresh water that flows along the fresh-water supply line 10*a* towards the water-softening agent container 28, directly towards the water supply line 22*a* of detergent dispensing assembly 9 that channels the fresh water to the detergent compartment 20*a* structured for containing the amount of detergent or other washing agent to be used in the main-wash phase of the washing cycle, thus bypassing at once the whole water-softening agent container 28.

The water by-pass circuit 75, therefore, allows to selectively channel non-softened fresh water to the detergent compartment 20*a* structured for containing the amount of detergent or other washing agent to be used in the main-wash phase of the washing cycle.

In the example shown, in particular, the water by-pass circuit 75 preferably comprises a connecting pipeline 77 that branches off from pipeline 71 of fresh-water supply line 10*a* upstream of on-off valve 73, and connects again to pipeline 71, or directly to the inlet of the corresponding water supply line 22*a* of detergent dispensing assembly 9, downstream of the water-softening agent container 28; and an electrically-controlled on-off valve 78 which is located along the connecting pipeline 77 so as to be able to selectively and alternatively allow or prevent the flow of fresh water along connecting pipeline 77, directly towards the corresponding water supply line 22*a* of detergent dispensing assembly 9 while bypassing at once the whole water-softening agent container 28.

The auxiliary water drain line 76, in turn, is structured for selectively rerouting directly into the washing tub 3 the brine or fresh water that comes out from the resin container 28 and flows along the fresh-water supply line 10*a* directed towards the detergent dispensing assembly 9, so as to bypass the detergent comportment 20*a* of detergent drawer 20 which is structured for containing the amount of detergent or other washing agent to be used in the main-wash phase of the washing cycle.

Alike the water drain line 43, the auxiliary water drain line 76 may also be structured for directly channelling the brine or fresh water coming out from the resin container 28 directed towards the detergent dispensing assembly 9, preferably into the drain sump (not shown) that extends downwards form the bottom of washing tub 3, or into the water filtering assembly (not shown) that is interposed between the drain sump (not shown) of washing tub 3 and the suction of the water circulating pump (not shown) and/or of the water exhaust pump (not shown) of the laundry washing machine 1, or in any case into the waste-water drain line that channels the waste water or washing liquor outside the laundry washing machine 1.

In the example shown, in particular, the auxiliary water drain line 76 is structured to selectively reroute the brine or fresh water that flows out of the resin container 28 along the final section of pipeline 71, and preferably comprises, immediately upstream of the detergent dispensing assembly 9, an electrically-controlled three-way valve 79 which has a first outlet connected to the inlet of the appropriate water supply line 22*a* of water supply circuit 22, and a second outlet connected to a pipeline 80 that ends directly into the washing tub 3, or into the drain sump, or into the water filtering assembly, or into the water exhaust pump.

The electrically-controlled three-way valve 79 is structured for selectively and alternatively channelling the brine or softened fresh water coming out of the resin container 28 either to pipeline 80 or to the inlet of the water supply line 22*a* of water supply circuit 22.

Lastly, in a non-shown and less-sophisticated embodiment the brine-circulating pump or pump assembly 31 may be replaced by an electrically-controlled on-off valve which is structured to selectively and alternatively put the regeneration-agent reservoir 29 in direct communication with the water-softening agent container 28 for allowing the brine to flow by gravity from the regeneration-agent reservoir 29 to the beneath located water-softening agent container 28, or to completely watertight seal/isolate the regeneration-agent reservoir 29 from the beneath located water-softening agent container 28.

The invention claimed is:

1. A laundry washing machine comprising an outer casing having a front wall and an appliance control panel located on the front wall, close to a worktop of the casing, and, inside said outer casing, a washing tub, a rotatable drum housed in axially rotatable manner inside the washing tub and structured for housing the laundry to be washed, a detergent dispensing assembly which is structured for supplying detergent into the washing tub, a fresh-water supply circuit which is structured for selectively channeling a flow of fresh water from a water mains towards the detergent dispensing assembly and/or the washing tub, and a water softening device which is arranged/located along the fresh-water supply circuit and is structured for reducing the hardness degree of the fresh water channeled to the detergent dispensing assembly and/or the washing tub;

the detergent dispensing assembly arranged/located inside the casing so that loading inlet of the detergent dispensing assembly is exposed or exposable to outside of the front wall of the casing substantially beside the appliance control panel;

the water softening device in turn comprising a water-softening agent container which is arranged/located along the fresh-water supply circuit and is filled with a water softening agent able to reduce the hardness degree of the fresh water flowing through the same water-softening agent container, and a regeneration-agent reservoir which is fluidly connected to the water-softening agent container and is structured to receive a consumable regeneration agent for performing a regeneration of a water softening function of the water softening agent stored into the water-softening agent container; and the laundry washing machine wherein the appliance control panel is structured for allowing the user to manually select a desired washing-cycle, wherein the regeneration-agent reservoir is provided with a loading inlet structured for allowing the user to load a regeneration agent inside the same regeneration-agent reservoir and is arranged/located inside the casing so that said loading inlet is exposed or exposable to outside of the casing and is located/arranged on a portion of said worktop located immediately behind the appliance control panel.

2. The laundry washing machine according to claim 1, wherein the loading inlet of the regeneration-agent reservoir is freely accessible by the user through a manually-operated closure assembly provided on the worktop of the casing.

3. The laundry washing machine according to claim 2, wherein said manually-operated closure assembly comprises a door provided on the worktop of the casing; said door being movable to and from a closing position wherein the door hides the loading inlet of the regeneration-agent reservoir.

4. The laundry washing machine according to claim 3, wherein said door forms a portion of the worktop of the casing.

5. The laundry washing machine according to claim 3, wherein the worktop of the casing is provided with an inner shelf which is arranged beneath the door, and the loading inlet of the regeneration-agent reservoir is located/incorporated into said inner shelf.

6. The laundry washing machine according to claim 1, wherein the appliance control panel is located substantially beneath the worktop of the casing, substantially on an upper corner of the front wall of said casing.

7. The laundry washing machine according to claim 1, wherein the detergent dispensing assembly is provided with a corresponding loading inlet of the detergent dispensing assembly which is structured for allowing the user to load the washing agent inside the same detergent dispensing assembly.

8. The laundry washing machine according to claim 7, wherein the detergent dispensing assembly comprises a detergent container which is fillable with a given quantity of detergent, softener and/or other washing agent, and which is housed inside the casing into a corresponding container housing; the front wall of the casing being provided with a corresponding pass-through opening through which the detergent container is accessible by the user.

9. The laundry washing machine according to claim 8, wherein the detergent dispensing assembly comprises a detergent drawer which is manually fillable with a given quantity of detergent, softener and/or other washing agent, and is fitted/inserted in manually extractable manner into a recessed drawer housing which extends inside the casing while remaining above the washing tub, and communicates with an outside of the casing via a front opening realized on the front wall of the casing beside the appliance control panel.

10. The laundry washing machine according to claim 1, wherein the water softening device further comprises a water supply circuit which is structured for channeling a given amount of fresh water into the regeneration-agent reservoir so to at least partly dissolve the regeneration agents stored therein to form some brine.

11. The laundry washing machine according to claim 1, wherein the water softening device further comprises a pump assembly or valve assembly which is interposed between the water-softening agent container and the regeneration-agent reservoir, and which is structured for regulating/ controlling the outflow of brine from the regeneration-agent reservoir to the water-softening agent container.

12. The laundry washing machine according to claim 1, wherein the regeneration-agent reservoir comprises a substantially basin-shaped, regeneration-agent container having a mouth which is manually fillable with a given quantity of consumable regeneration agent, and is recessed/incorporated into the worktop of the casing on a portion of the worktop located behind the appliance control panel, so that the mouth of the regeneration-agent container is freely accessible by the user.

13. The laundry washing machine according to claim 12, wherein the regeneration-agent container is recessed/incorporated into an inner shelf of the worktop behind the appliance control panel, so that the mouth of the regeneration-agent container is freely accessible by the user through a manually-operated closure assembly.

14. The laundry washing machine according to claim 12, wherein a water supply circuit of the water softening device is structured for spilling/pouring a shower of water droplets by gravity into the substantially basin-shaped container of the regeneration-agent reservoir.

15. The laundry washing machine according to claim 1, wherein the regeneration-agent reservoir comprises: a storage tank which is structured for being manually fillable with a given quantity of consumable regeneration agent, and which is arranged/located immediately underneath the worktop of the casing, so as to be freely accessible by the user from the worktop of the casing; and a manually-removable cap which is structured to close the storage tank.

16. The laundry washing machine according to claim 15, wherein a water supply circuit of the water softening device is structured for channeling the fresh water directly into the storage tank, so as to dissolve the regeneration agents contained into the storage tank and form some brine.

17. The laundry washing machine according to claim 15, wherein the regeneration-agent reservoir further comprises an overflow drain line which fluidly connects the storage tank to the washing tub or to a waste-water drain line that channels the waste water or washing liquor outside the laundry washing machine.

18. The laundry washing machine according to claim 15, wherein the storage tank is recessed/incorporated into an inner shelf of the worktop in a manually removable manner.

* * * * *